US008196673B2

(12) United States Patent
Wallace

(10) Patent No.: US 8,196,673 B2
(45) Date of Patent: Jun. 12, 2012

(54) METHOD AND APPARATUS FOR DETERMINING WHEN A THREADED FASTENER HAS BEEN TIGHTENED TO A PREDETERMINED TIGHTNESS

(76) Inventor: Paul William Wallace, Furlong, PA (US)

( * ) Notice: Subject to any disclaimer, the term of this patent is extended or adjusted under 35 U.S.C. 154(b) by 55 days.

(21) Appl. No.: 12/375,809

(22) PCT Filed: Aug. 2, 2007

(86) PCT No.: PCT/IE2007/000077

§ 371 (c)(1),
(2), (4) Date: Apr. 22, 2009

(87) PCT Pub. No.: WO2008/015661

PCT Pub. Date: Feb. 7, 2008

(65) Prior Publication Data

US 2009/0250233 A1 Oct. 8, 2009

(30) Foreign Application Priority Data

Aug. 2, 2006 (IE) ..... S2006/0573

(51) Int. Cl.
*B25B 21/00* (2006.01)

(52) U.S. Cl. ..... 173/1; 173/176

(58) Field of Classification Search ..... 173/1, 176, 173/183; 73/862.21; 81/467
See application file for complete search history.

(56) References Cited

U.S. PATENT DOCUMENTS

| | | | | |
|---|---|---|---|---|
| 4,305,471 | A * | 12/1981 | Eshghy | 173/183 |
| 4,358,735 | A | 11/1982 | Boys | |
| 4,400,785 | A * | 8/1983 | Wallace et al. | 702/43 |
| RE31,569 | E * | 5/1984 | Eshghy | 29/407.02 |
| 4,609,089 | A | 9/1986 | Kobayashi et al. | |
| 2002/0134172 | A1 * | 9/2002 | Yamada et al. | 73/862.21 |

FOREIGN PATENT DOCUMENTS

| | | | |
|---|---|---|---|
| EP | 1059145 | A2 | 12/2000 |
| EP | 1447177 | A2 | 8/2004 |
| EP | 1524085 | A2 | 4/2005 |
| EP | 1595650 | A2 | 11/2005 |
| WO | 02060650 | A2 | 8/2002 |

* cited by examiner

*Primary Examiner* — Rinaldi Rada
*Assistant Examiner* — Nathaniel Chukwurah
(74) *Attorney, Agent, or Firm* — Sughrue Mion, PLLC

(57) ABSTRACT

Apparatus for determining when a fastener has been tightened by an impact wrench comprises determining when the number of hammer impacts to advance an anvil of the impact wrench through a predetermined angle reaches a predetermined number. The cumulative angular displacement of the anvil from the first detected hammer impact is determined from the corresponding cumulative angular displacement of the hammer at the corresponding hammer impact from the first detected hammer impact. The cumulative angular displacement of the hammer is determined just prior to the direction of rotation of the hammer reversing at the corresponding hammer impact, and is determined by computing the difference between the cumulative angular displacements of the hammer at the corresponding and previous hammer impacts and subtracting an angle through which the hammer freely rotates between the two hammer impacts from the computed difference. The result is added to the cumulative angular displacement of the anvil computed for the previous hammer impact.

21 Claims, 10 Drawing Sheets

Figure 1:
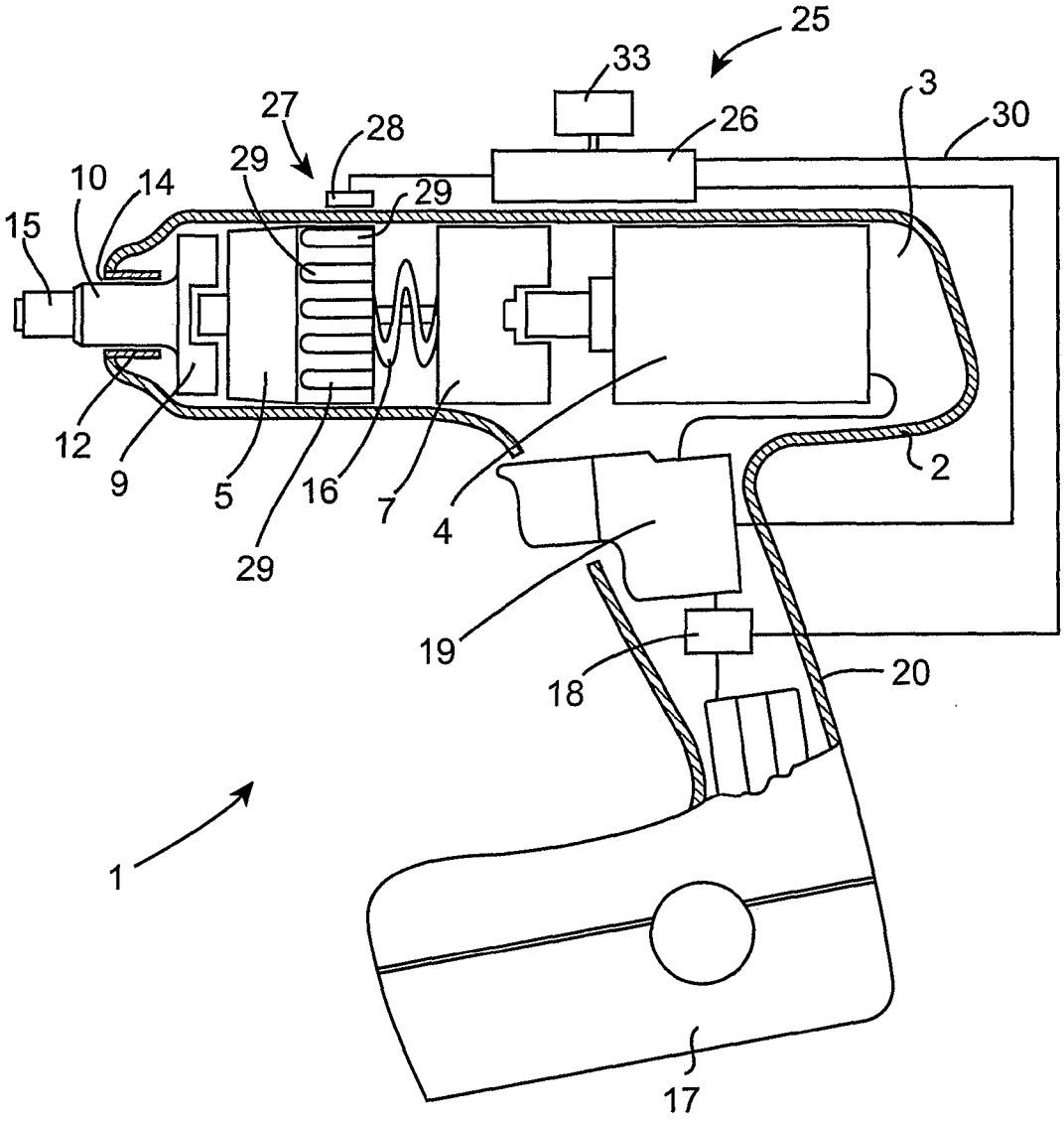

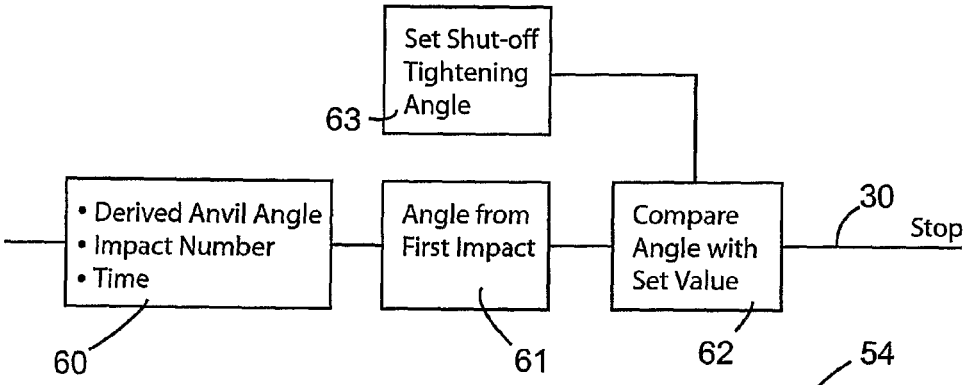
Fig. 9
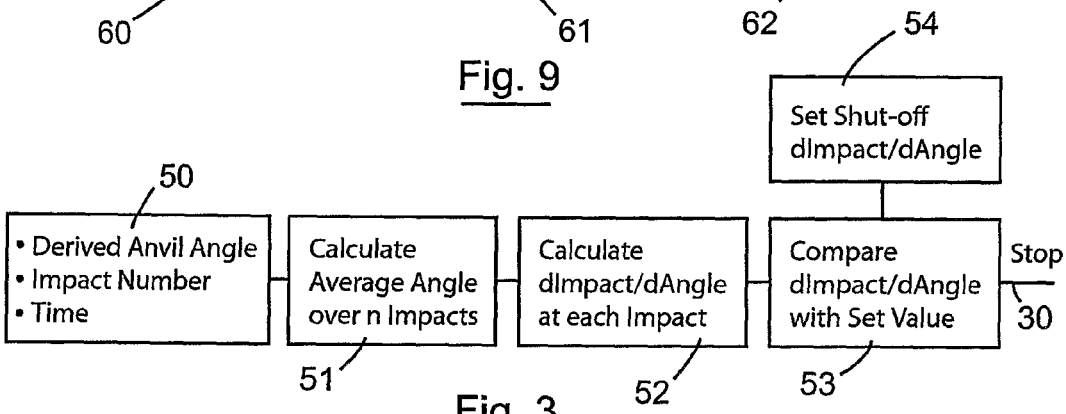
Fig. 3
| A | B | C | F | J | K |
|---|---|---|---|---|---|
| Impact No. | Derived Anvil Angle (net of Free 180 deg) | Smoothed Angle - 2pt Moving avg. | dImpact/ dAngle 2 Chord derivative | Integration of Col F dimpact/ dAngle 2 Chord derivative | Average of Integrated dImpact/dAngle 2 Chord derivative |
| A1 | C1 | 0 | 0 | | |
| A2 | C2 | D2 = (C2+C1)/2 | 0 | | |
| A3 | C3 | D3 = (C3+C2)/2 | F3 = (A3-A1)/ (D3-D1) | J3 = J2 + F3 | K3 = J3/A3 |
| A4 | C4 | D4 = (C4+C3)/2 | F4 = (A4-A2)/ (D4-D2) | J4 = J3 + F4 | K4 = J4/A4 |
| A5 | C5 | D5 = (C5+C4)/2 | F5 = (A5-A3)/ (D5-D3) | J5 = J4 + F5 | K5 = J5/A5 |
Fig. 4

METHOD AND APPARATUS FOR DETERMINING WHEN A THREADED FASTENER HAS BEEN TIGHTENED TO A PREDETERMINED TIGHTNESS

The present invention relates to a method and apparatus for determining when a threaded fastener has been tightened to a predetermined level of tightness by an impact wrench, and the invention also relates to an impact wrench.

Impact wrenches are widely used for tightening threaded fasteners, and are known for their speed and their ability to generate high torques. A typical impact wrench comprises a motor driven rotary hammer which drives an output shaft by impacting through an impact mechanism on an anvil on the output shaft. The impact mechanism is coupled to the drive motor, typically through a rotationally flexible coupling. The hammer which is driven through the impact mechanism periodically impacts with the anvil to angularly advance the anvil. The impact mechanism allows the drive motor to freely accelerate the hammer through a known free angle of rotation before the hammer impacts on the anvil and the hammer is brought to a stop. The known free rotational angle of the hammer depends on the impact mechanism used and the number of impacts the hammer makes with the anvil per revolution of the hammer. In typical impact wrenches the hammer makes one or two impacts with the anvil per revolution of the hammer, and in the case of a two impact per revolution hammer the free rotational angle between impacts is approximately 180°. During each impact of the hammer with the anvil, a substantial percentage of the kinetic energy in the hammer is transferred to the anvil with the result that the anvil is angularly advanced and a further high percentage of the kinetic energy is transferred through the output shaft to the fastener being tightened. After each impact, the impact mechanism releases the hammer, which is then free to accelerate through the known free rotational angle before making the next impact with the anvil.

Unfortunately, control of the fastening process with an impact wrench is difficult to achieve. To adequately control the fastening process, a control system must consistently stop the impact wrench at a point at which the fastener has been tightened to a predetermined level of tightness. Various attempts have been made to provide control systems for controlling the fastening process of an impact wrench, however, in general, no such system has to date provided an adequate degree of consistency in determining when a fastener has been tightened to a predetermined level of tightness.

There is therefore a need for a method and apparatus for determining when a threaded fastener has been tightened to a predetermined level of tightness by an impact wrench which produces results which are more consistent than methods and apparatus known heretofore.

The present invention is directed towards providing such a method and apparatus, and the invention is also directed to an impact wrench.

According to the invention there is provided a method for determining when a threaded fastener has been tightened to a predetermined level of tightness by an impact wrench of the type comprising a rotary anvil and a rotary hammer for impacting with the anvil and angularly advancing the anvil in response to each hammer impact, and a coupling means for coupling the anvil to the fastener for rotating the fastener as the anvil is being angularly advanced, the method comprising determining one of the angle by which the anvil is advanced in response to each of at least some of the hammer impacts, and the angle of rebound of the hammer resulting from each of at least some of the impacts of the hammer with the anvil, and determining that the fastener has been tightened to the predetermined tightness level when one of

- the angle through which the anvil is advanced by one of the hammer impacts falls below a predetermined angle,
- the number of hammer impacts to advance the anvil through a predetermined angle exceeds a predetermined number of hammer impacts, and
- the angle of rebound of the hammer exceeds a predetermined rebound angle.

In one embodiment of the invention the number of hammer impacts required to advance the anvil through the predetermined angle is derived from the determination of the angles by which the anvil is advanced in response to the at least some of the hammer impacts.

In another embodiment of the invention the angular position of the anvil on each impact of the hammer with the anvil is determined from the angular position of the hammer at impact with the anvil.

Preferably, the angular position of the anvil is determined as being equivalent to the angular position of the hammer at the corresponding impact of the hammer with the anvil.

Advantageously, the angular position of the hammer at each hammer impact is determined by determining the angular speed of the hammer.

In one embodiment of the invention the angular position of the hammer at each hammer impact is determined by determining when the forward angular speed of the hammer is at a minimum value. Preferably, the angular position of the hammer at each hammer impact is determined by determining when the forward angular speed of the hammer is approaching zero angular speed. Advantageously, the angular position of the hammer at each hammer impact is determined by determining when the forward angular speed of the hammer reduces to zero angular speed. Ideally, the angular position of the hammer at each hammer impact is determined just prior to the direction of rotation of the hammer reversing on impacts in which the direction of rotation of the hammer reverses due to rebound of the hammer after impact with the anvil.

In one embodiment of the invention the angular position of the anvil is determined at the instant the forward angular speed of the hammer is at a minimum value. Preferably, the angular position of the anvil is determined at the instant the forward angular speed of the hammer is approaching zero angular speed. Advantageously, the angular position of the anvil is determined at the instant the forward angular speed of the hammer reduces zero angular speed.

In another embodiment of the invention the angle through which the anvil is advanced in response to each hammer impact is derived from the angular rotation of the hammer between the corresponding hammer impact and the previous hammer impact. Preferably, the angle through which the anvil is advanced in response to each hammer impact is determined by determining the difference between the cumulative angular displacement of the hammer at the corresponding hammer impact and the cumulative angular displacement of the hammer at the previous hammer impact, and subtracting from the difference a predetermined angle corresponding to a known free rotational angle through which the hammer rotates relative to the anvil between consecutive hammer impacts.

In another embodiment of the invention the angle through which the anvil is advanced in response to each of the at least some of the hammer impacts is determined using a smoothing algorithm for minimising the effect of noise on the determined angle. Preferably, the smoothing algorithm is a moving average algorithm. Advantageously, under the smoothing algorithm the angles through which the anvil is advanced in response to at least two corresponding hammer impacts are averaged. Ideally, under the smoothing algorithm the angles through which the anvil is advanced in response to corresponding consecutive hammer impacts are averaged.

In another embodiment of the invention the number of hammer impacts required to advance the anvil through the predetermined angle is determined using the smoothing algorithm. Preferably, the smoothing algorithm comprises computing a two-chord derivative of the angle through which the anvil is advanced in response to corresponding hammer impacts. Advantageously, the two-chord derivative is derived from the most recently computed average value of the angle by which the anvil is advanced by the corresponding hammer impact and the average value of the angle by which the anvil is advanced by the previously but one hammer impact.

In another embodiment of the invention the smoothing algorithm further comprises integrating the two-chord derivative of the number of hammer impacts per angle of advance of the anvil. Preferably, the smoothing algorithm comprises deriving the integral corresponding to a hammer impact as a function of the integral computed corresponding to the previous hammer impact, and summing the derived integral with the two-chord derivative computed corresponding to the current hammer impact.

In one embodiment of the invention the angle of rebound of the hammer resulting from each impact of the hammer with the anvil is determined by determining the angular position of the hammer after the hammer has rebounded.

In another embodiment of the invention the angular position of the hammer after the hammer has rebounded as a result of each hammer impact with the anvil is determined by determining the angular speed of the hammer.

In a further embodiment of the invention the angular position of the hammer after the hammer has rebounded as a result of each hammer impact is determined by determining when the rearward angular speed of the hammer is at a minimum value after the direction of rotation of the hammer has reversed after the corresponding impact with the anvil. Preferably, the angular position of the hammer after the hammer has rebounded as a result of each hammer impact is determined by determining when the rearward angular speed of the hammer is approaching zero angular speed after the direction of rotation of the hammer has reversed after the corresponding impact with the anvil. Advantageously, the angular position of the hammer after the hammer has rebounded as a result of each hammer impact is determined by determining when the rearward angular speed of the hammer reduces to zero angular speed after the direction of rotation of the hammer has reversed after the corresponding impact with the anvil.

In one embodiment of the invention the angular position of the hammer after the hammer has rebounded as a result of each hammer impact is determined just prior to the direction of rotation of the hammer changing to a forward rotational direction.

In another embodiment of the invention the angle of rebound of the hammer resulting from each hammer impact is determined by determining the difference between the cumulative angular displacement of the hammer at the corresponding hammer impact and the cumulative angular displacement of the hammer after the hammer has rebounded.

In a further embodiment of the invention the angle of rebound of the hammer as a result of each hammer impact is determined by applying a smoothing algorithm for minimising the effect of noise on the determined angle. Preferably, the smoothing algorithm is a moving average algorithm. Advantageously, under the smoothing algorithm the angles through which the hammer rebounds in response to at least two corresponding hammer impacts are averaged. Ideally, under the smoothing algorithm the angles through which the hammer rebounds in response to corresponding consecutive hammer impacts are averaged. Preferably, under the smoothing algorithm a weighting factor based on the rate of change of the angle of rebound of the hammer is applied to the computed angle of rebound.

In one embodiment of the invention a deactivating signal is outputted in response to the fastener being determined as being tightened to the predetermined tightness level for deactivating the impact wrench.

In another embodiment of the invention the maximum forward angular speed of the hammer is determined just prior to impact of the hammer with the anvil.

Preferably, the maximum forward angular speed of the hammer just prior to impact is compared with a predetermined minimum angular speed value, and if the maximum forward angular speed of the hammer just prior to impact fails to reach the predetermined minimum angular speed value, a low speed alert signal is outputted.

Advantageously, the maximum forward angular speed of the hammer just prior to impact is compared with a predetermined maximum angular speed value, and if the maximum forward angular speed of the hammer just prior to impact exceeds the predetermined maximum angular speed value, a high speed alert signal is outputted.

Ideally, the one of the predetermined angle through which the anvil is to be advanced by one hammer impact, the predetermined number of hammer impacts required to advance the anvil through a predetermined angle, and the predetermined angle of rebound which correspond to the fastener being tightened to the predetermined tightness level is varied in response to variation in the maximum forward angular speed of the hammer just prior to impact with the anvil.

The invention also provides a method for determining when a threaded fastener has been tightened to a predetermined level of tightness by an impact wrench of the type comprising a rotary anvil and a rotary hammer for impacting with the anvil and angularly advancing the anvil in response to each hammer impact, and a coupling means for coupling the anvil to the fastener for rotating the fastener as the anvil is being angularly advanced, the method comprising determining the angle by which the anvil is advanced in response to each of at least some of the hammer impacts, and determining that the fastener has been tightened to the predetermined tightness level when the angle through which the anvil is advanced by one of the hammer impacts falls below a predetermined angle.

The invention further provides a method for determining when a threaded fastener has been tightened to a predetermined level of tightness by an impact wrench of the type comprising a rotary anvil and a rotary hammer for impacting with the anvil and angularly advancing the anvil in response to each hammer impact, and a coupling means for coupling the anvil to the fastener for rotating the fastener as the anvil is being angularly advanced, the method comprising determining the number of hammer impacts required to advance the anvil through a predetermined angle, and determining that the fastener has been tightened to the predetermined tightness level when the number of hammer impacts to advance the anvil through the predetermined angle exceeds a predetermined number of hammer impacts.

The invention also provides a method for determining when a threaded fastener has been tightened to a predetermined level of tightness by an impact wrench of the type comprising a rotary anvil and a rotary hammer for impacting with the anvil and angularly advancing the anvil in response to each hammer impact, and a coupling means for coupling the anvil to the fastener for rotating the fastener as the anvil is being angularly advanced, the method being based on determining one of an angle by which the anvil is advanced and a number of impacts of the hammer with the anvil, the angular position of the anvil being determined on at least some of the impacts of the hammer with the anvil, and the at least some of the impacts of the hammer with the anvil being determined by monitoring the angular speed of the hammer.

Preferably, an impact of the hammer with the anvil is determined as being an instant when the forward angular speed of the hammer is a minimum. Advantageously, an impact of the hammer with the anvil is determined as being an instant when the forward angular speed of the hammer is approaching zero radians per second. Ideally, an impact of the hammer with the anvil is determined as being an instant when the forward angular speed of the hammer reduces to zero radians per second. Preferably, an impact of the hammer with the anvil is determined as being an instant just prior to the direction of rotation of the hammer reversing.

In one embodiment of the invention the angle of the anvil on an impact of the hammer with the anvil is determined from the angular position of the hammer at the impact thereof with the anvil.

In another embodiment of the invention the tightness of the fastener is determined as a function of the cumulative angular displacement of the anvil after a predetermined impact of the hammer with the anvil. Preferably, the predetermined impact of the hammer with the anvil is the first detectable impact of the hammer with the anvil. Alternatively, the predetermined impact of the hammer with the anvil is an impact of the hammer with the anvil which resulted in the anvil being advanced by a predetermined angle.

In another embodiment of the invention the tightness of the fastener is determined as a function of the cumulative number of hammer impacts with the anvil after a predetermined impact of the hammer with the anvil. Preferably, the predetermined impact of the hammer with the anvil is the first detectable impact of the hammer with the anvil. Advantageously, the predetermined impact of the hammer with the anvil is an impact of the hammer with the anvil which resulted in the anvil being advanced by a predetermined angle.

In another embodiment of the invention the angle by which the anvil is advanced in response to each hammer impact is derived from the angular rotation of the hammer between respective hammer impacts.

In another embodiment of the invention the angle by which the anvil is advanced in response to each hammer impact is derived from the angular rotation of the hammer between consecutive hammer impacts.

Preferably, the angle through which the anvil is advanced by each hammer impact is determined by determining the difference between the cumulative angular displacement of the hammer at the hammer impact and the cumulative angular displacement of the hammer at the corresponding previous hammer impact, and subtracting from the difference a predetermined angle corresponding to a known free rotational angle through which the hammer rotates relative to the anvil between consecutive hammer impacts.

In one embodiment of the invention a deactivating signal is outputted in response to the fastener being determined as being tightened to the predetermined tightness level for deactivating the impact wrench.

Further the invention provides a method for determining when a threaded fastener has been tightened to a predetermined level of tightness by an impact wrench of the type comprising a rotary anvil and a rotary hammer for impacting with the anvil and angularly advancing the anvil in response to each hammer impact, and a coupling means for coupling the anvil to the fastener for rotating the fastener as the anvil is being angularly advanced, the method comprising determining the angle of rebound of the hammer resulting from impact of the hammer with the anvil on at least some of the hammer impacts, and determining that the fastener has been tightened to the predetermined tightness level when the angle of rebound of the hammer exceeds a predetermined rebound angle.

Additionally the invention provides apparatus for determining when a threaded fastener has been tightened to a predetermined level of tightness by an impact wrench of the type comprising a rotary anvil and a rotary hammer for impacting with the anvil and angularly advancing the anvil in response to each hammer impact, and a coupling means for coupling the anvil to the fastener for rotating the fastener as the anvil is being angularly advanced, the apparatus comprising a means for determining one of the angle through which the anvil is advanced in response to each of at least some of the hammer impacts, and the angle of rebound of the hammer resulting from each of at least some of the impacts of the hammer with the anvil, and a means for determining that the fastener has been tightened to the predetermined tightness level when one of

- the angle through which the anvil is advanced by one of the hammer impacts falls below a predetermined angle,
- the number of impacts to advance the anvil through a predetermined angle exceeds a predetermined number of hammer impacts, and
- the angle of rebound of the hammer exceeds a predetermined rebound angle.

In one embodiment of the invention a means is provided for determining the number of hammer impacts required to advance the anvil through the predetermined angle, the means for determining the number of hammer impacts being responsive to the means for determining the angle by which the anvil is advanced in response to each of the at least some of the hammer impacts.

In another embodiment of the invention a means is provided for determining the angular position of the hammer on each impact of the hammer with the anvil, and a means for determining the angular position of the anvil on each hammer impact with the anvil is provided.

Preferably, the means for determining the angular position of the anvil determines the angular position of the anvil from the means for determining the angular position of the hammer as being equivalent to the angular position of the hammer at the corresponding impact of the hammer with the anvil.

Advantageously, the means for determining the angular position of the hammer at each hammer impact determines the angular speed of the hammer.

In one embodiment of the invention the means for determining the angular position of the hammer at each hammer impact determines the angular position of the hammer at each hammer impact as being the position of the hammer when the forward angular speed of the hammer is at a minimum value. Preferably, the means for determining the position of the hammer at each hammer impact determines the angular position of the hammer at each hammer impact as being the position of the hammer when the forward angular speed of the hammer is approaching zero angular speed. Advantageously, the means for determining the angular position of the hammer at each hammer impact determines the angular position of the hammer at each hammer impact as being the position of the hammer when the forward angular speed of the hammer reduces zero angular speed.

Ideally, the means for determining the angular position of the hammer at each hammer impact determines the angular position of the hammer at each hammer impact just prior to the direction of rotation of the hammer reversing.

In another embodiment of the invention the means for determining the angle through which the anvil is advanced in response to each hammer impact determines the angle from the angular rotation of the hammer between the corresponding hammer impact and the previous hammer impact. Preferably, the means for determining the angle through which the anvil is advanced in response to each hammer impact determines the angle by determining the difference between the cumulative angular displacement of the hammer at the corresponding hammer impact and the cumulative angular displacement of the hammer at the previous hammer impact, and subtracting from the difference a predetermined angle corresponding to a known free rotational angle through which the hammer rotates relative to the anvil between consecutive hammer impacts.

In another embodiment of the invention the means for determining the angle through which the anvil is advanced in response to each of the at least some of the hammer impacts determines the angle by applying a smoothing algorithm for minimising the effect of noise on the determined angle.

In one embodiment of the invention the means for determining the angle of rebound of the hammer resulting from each impact of the hammer with the anvil determines the angular position of the hammer after the corresponding hammer has rebounded.

In another embodiment of the invention the means for determining the angular position of the hammer after the hammer has rebounded as a result of each hammer impact with the anvil determines the angular speed of the hammer.

Preferably, the means for determining the angular position of the hammer after the hammer has rebounded as a result of each hammer impact determines the angular position of the hammer when the rearward angular speed of the hammer is at a minimum value after the direction of rotation of the hammer has reversed after the corresponding impact with the anvil.

Advantageously, the means for determining the angular position of the hammer after the hammer has rebounded as a result of each hammer impact determines the angular position of the hammer when the rearward angular speed of the hammer is approaching zero angular speed after the direction of rotation of the hammer has reversed after the corresponding impact with the anvil.

Ideally, the means for determining the angular position of the hammer after the hammer has rebounded as a result of each hammer impact determines the angular position of the hammer when the rearward angular speed of the hammer reduces to zero angular speed after the direction of rotation of the hammer has reversed after the corresponding impact with the anvil.

In one embodiment of the invention the means for determining the angular position of the hammer after the hammer has rebounded as a result of each hammer impact determines the angular position of the hammer just prior to the direction of rotation of the hammer changing to a forward rotational direction.

In another embodiment of the invention the means for determining the angle of rebound of the hammer resulting from each hammer impact determines the difference between the cumulative angular displacement of the hammer at the corresponding hammer impact and the cumulative angular displacement of the hammer after the hammer has rebounded.

In another embodiment of the invention a means is provided for outputting a deactivating signal for deactivating the impact wrench, the means for outputting the deactivating signal being responsive to the means for determining that the fastener has been tightened to the predetermined tightness level.

In one embodiment of the invention a means is provided for determining the maximum forward angular speed of the hammer just prior to impact with the anvil.

Preferably, a means is provided for comparing the maximum forward angular speed of the hammer just prior to impact with a predetermined minimum angular speed value, and a means for outputting a low speed alert signal is responsive to the comparing means determining that the maximum forward angular speed of the hammer just prior to impact fails to reach the predetermined minimum angular speed value for outputting a low speed alert signal.

Advantageously, a comparing means is provided for comparing the maximum forward angular speed of the hammer just prior to impact with a predetermined maximum angular speed value, and a means for outputting a high speed alert signal is responsive to the comparing means determining that the maximum forward angular speed of the hammer just prior to impact exceeds the predetermined maximum angular speed value for outputting a high speed alert signal.

Ideally, a means responsive to variation in the maximum forward angular speed of the hammer just prior to impact is provided for varying the one of

- the predetermined angle through which the anvil is to be advanced by one hammer impact,
- the predetermined number of hammer impacts required to advance the anvil through a predetermined angle, and
- the predetermined angle of rebound corresponding to the fastener being tightened to the predetermined tightness level.

Further the invention provides apparatus for determining when a threaded fastener has been tightened to a predetermined level of tightness by an impact wrench of the type comprising a rotary anvil and a rotary hammer for impacting with the anvil and angularly advancing the anvil in response to each impact, and a coupling means for coupling the anvil to the fastener for rotating the fastener as the anvil is being angularly advanced, the apparatus comprising a means for determining the angle by which the anvil is advanced in response to each of at least some of the hammer impacts, and a means for determining that the fastener has been tightened to the predetermined tightness level when the angle through which the anvil is rotated by a hammer impact falls below a predetermined angle.

The invention also provides apparatus for determining when a threaded fastener has been tightened to a predetermined level of tightness by an impact wrench of the type comprising a rotary anvil and a rotary hammer for impacting with the anvil and angularly advancing the anvil in response to each impact, and a coupling means for coupling the anvil to the fastener for rotating the fastener as the anvil is being angularly advanced, the apparatus comprising a means for determining the number of hammer impacts required to advance the anvil through a predetermined angle, and a means for determining that the fastener has been fastened to the predetermined tightness level when the number of hammer impacts to advance the anvil through the predetermined angle exceeds a predetermined number.

The invention also provides apparatus for determining when a threaded fastener has been tightened to a predetermined level of tightness by an impact wrench, of the type comprising a rotary anvil and a rotary hammer for impacting with the anvil and angularly advancing the anvil in response to each hammer impact, and a coupling means for coupling the anvil to the fastener for rotating the fastener as the anvil is being angularly advanced, the apparatus comprising a means for monitoring the angular speed of the hammer, a means for determining the angular position of the anvil, the means for determining the angular position of the anvil being responsive to the monitoring means for monitoring the angular speed of the hammer, and a means for determining when the fastener is tightened to the predetermined tightness level, the means for determining when the fastener is tightened to the predetermined tightness level, is responsive to one of the angle by which the anvil is advanced and the number of hammer impacts with the anvil.

Further, the invention provides apparatus for determining when a threaded fastener has been tightened to a predetermined level of tightness by an impact wrench of the type comprising a rotary anvil and a rotary hammer for impacting with the anvil and angularly advancing the anvil in response to each hammer impact, and a coupling means for coupling the anvil to the fastener for rotating the fastener as the anvil is being angularly advanced, the apparatus comprising a means for determining the angle of rebound of the hammer resulting from each of at least some of the impacts of the hammer with the anvil, and a means for determining that the fastener has been tightened to the predetermined tightness level when the angle of rebound of the hammer exceeds a predetermined rebound angle.

The invention also provides an impact wrench comprising any of the apparatus according to the invention for determining when a threaded fastener has been tightened to a predetermined level of tightness.

In one embodiment of the invention the impact wrench further comprises a rotary anvil and a rotary hammer for impacting with the anvil and for angularly advancing the anvil in response to each impact, a coupling means for coupling the anvil to a fastener for rotating the fastener as the anvil is being angularly advanced, and a monitoring circuit for determining the angle by which the anvil is advanced in response to each of at least some of the hammer impacts, the apparatus for determining when the fastener has been tightened to the predetermined tightness level being responsive to the monitoring circuit.

Ideally, a drive means is provided for driving the hammer, and an isolating means is provided for selectively isolating the drive means from the hammer, the isolating means being responsive to the deactivating signal from the apparatus for determining when the fastener has been tightened to a predetermined tightness level.

The advantages of the invention are many. In particular, the method and apparatus for determining when a threaded fastener has been tightened to a predetermined level of tightness are particularly suitable for incorporating in an impact wrench, and provide a relatively simple and accurate method for determining when the fastener has been tightened to the predetermined level of tightness. The impact wrench according to the invention allows a determination to be made as to when a threaded fastener has been tightened to a predetermined tightness level to be made relatively accurately and simply. Additionally, the apparatus and the impact wrench according to the invention can be produced relatively simply with the minimum amount of moving parts.

Figure 2:
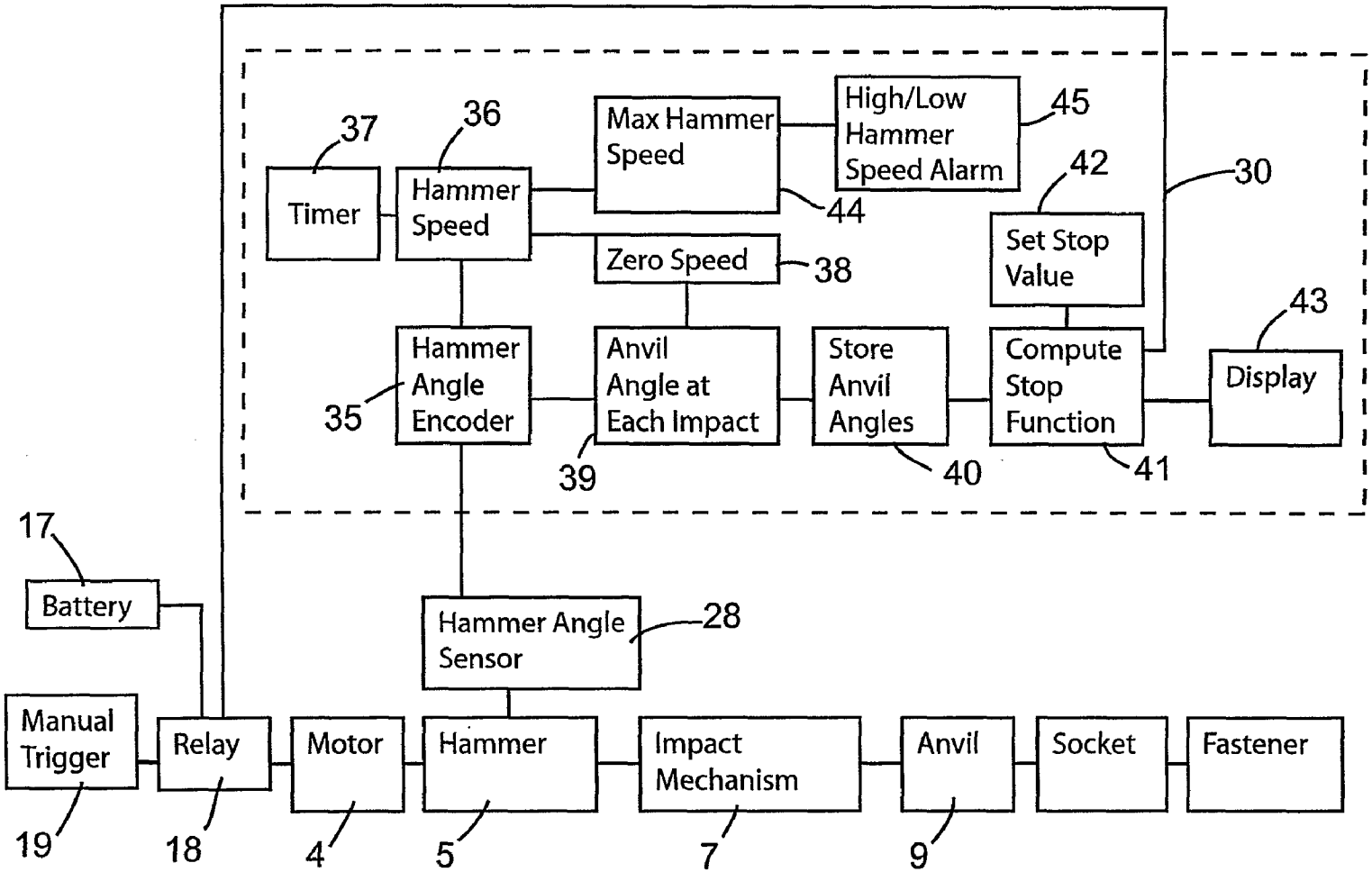
Figure 5:
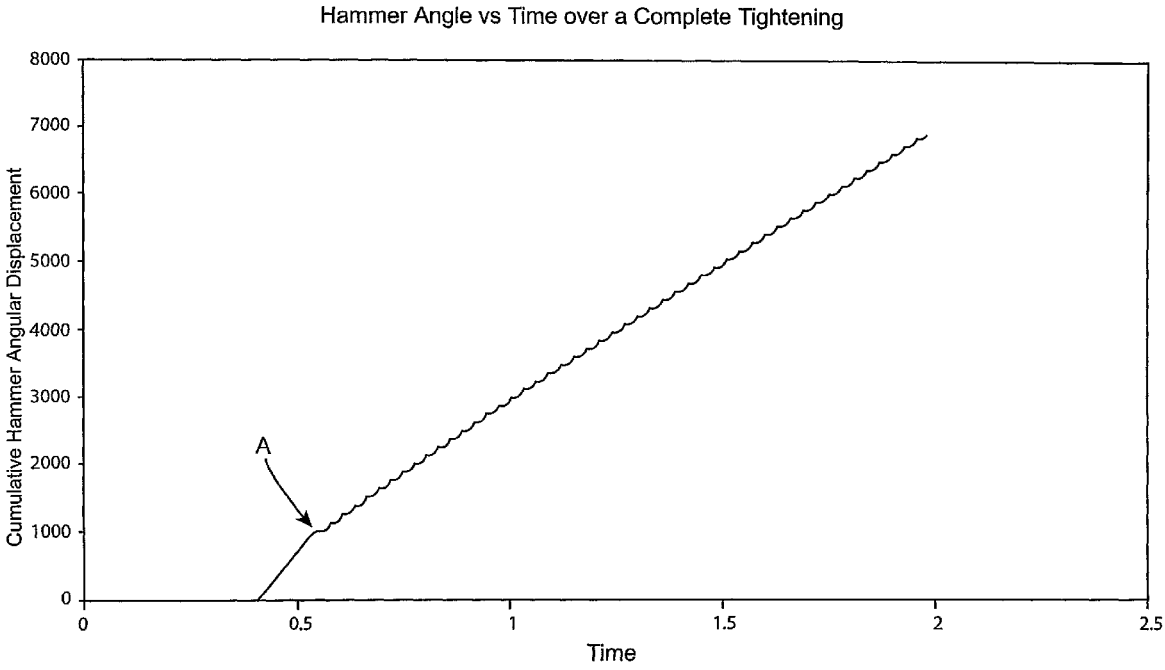
Figure 6:
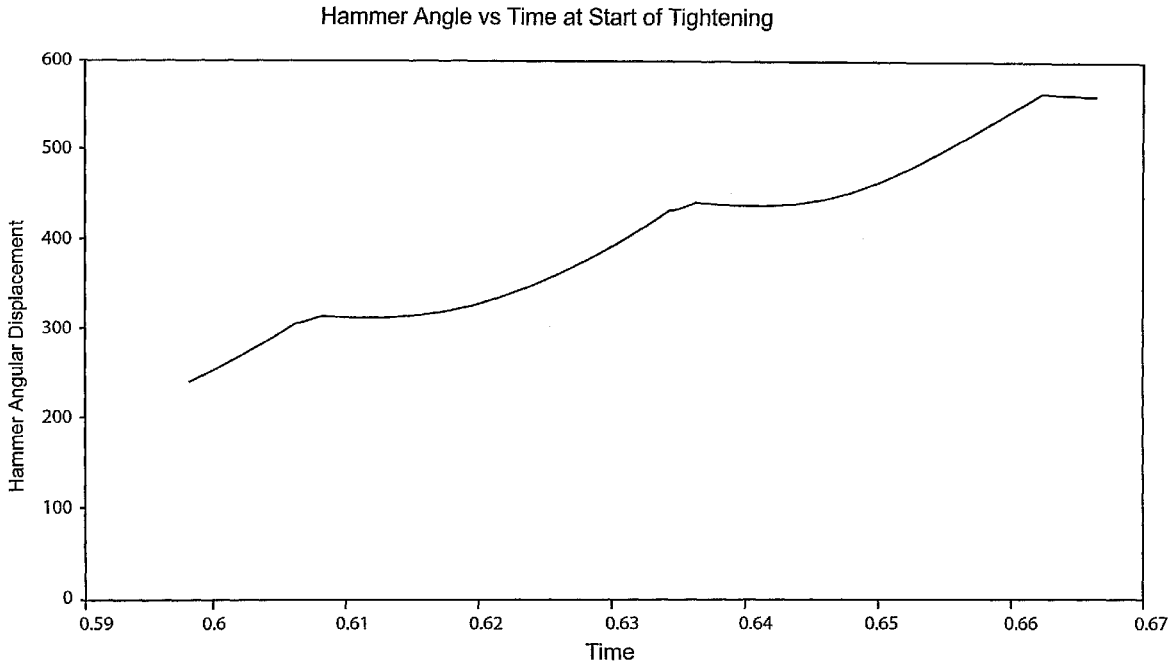
Figure 7:
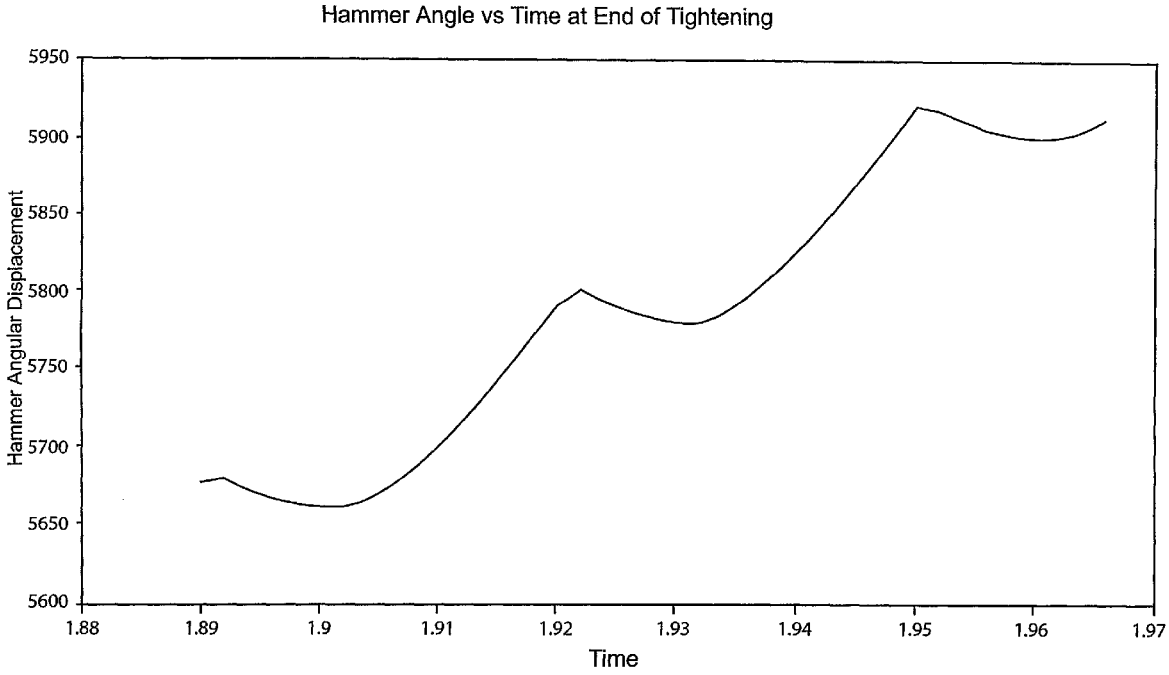
Figure 8:
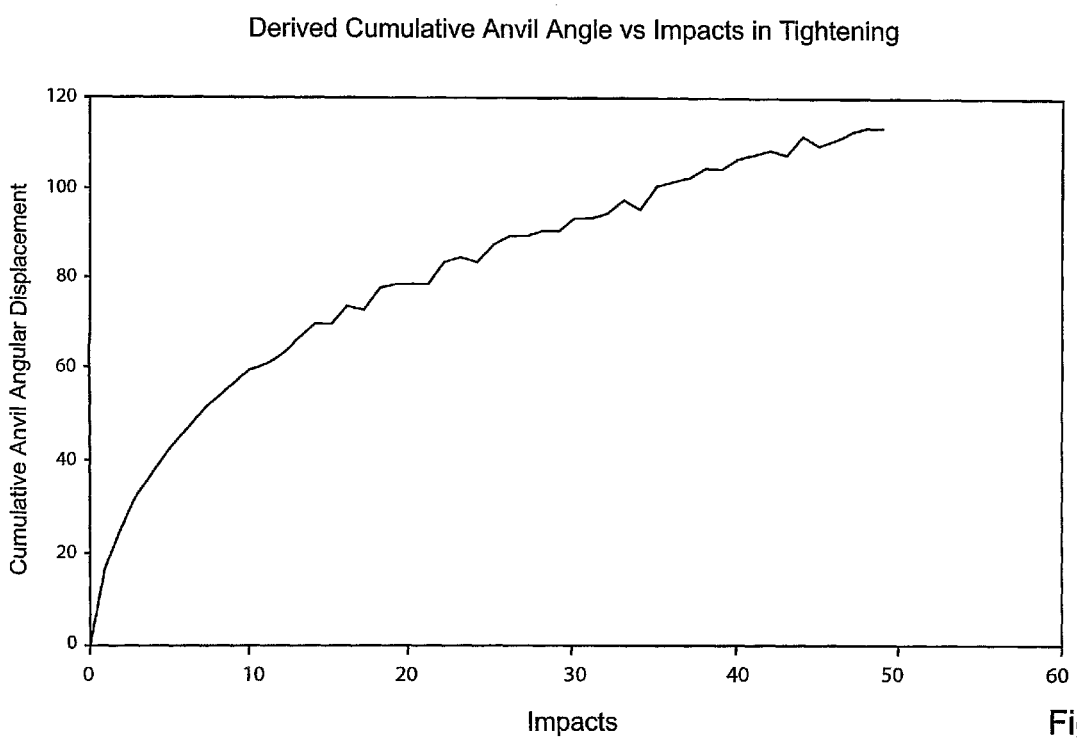
Figure 10:
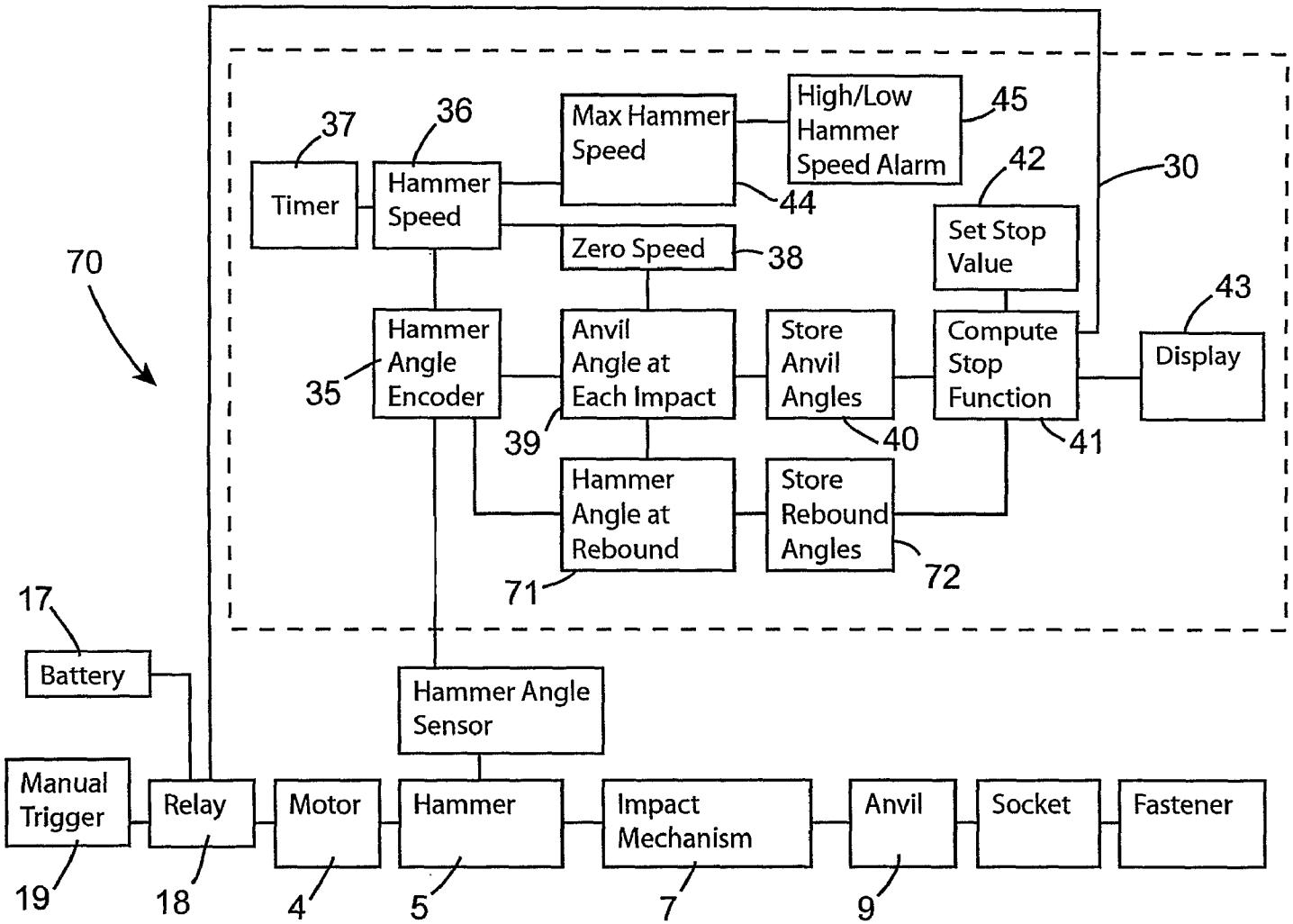
Figure 11:
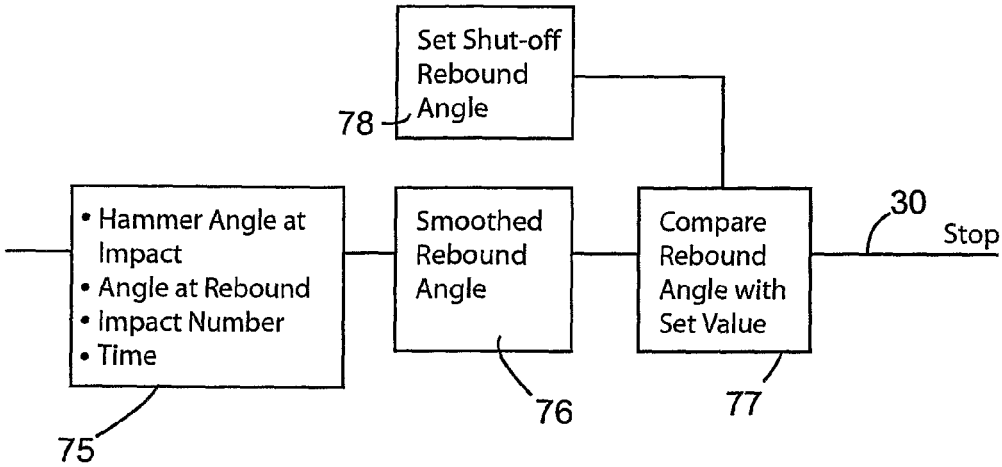
Figure 13:
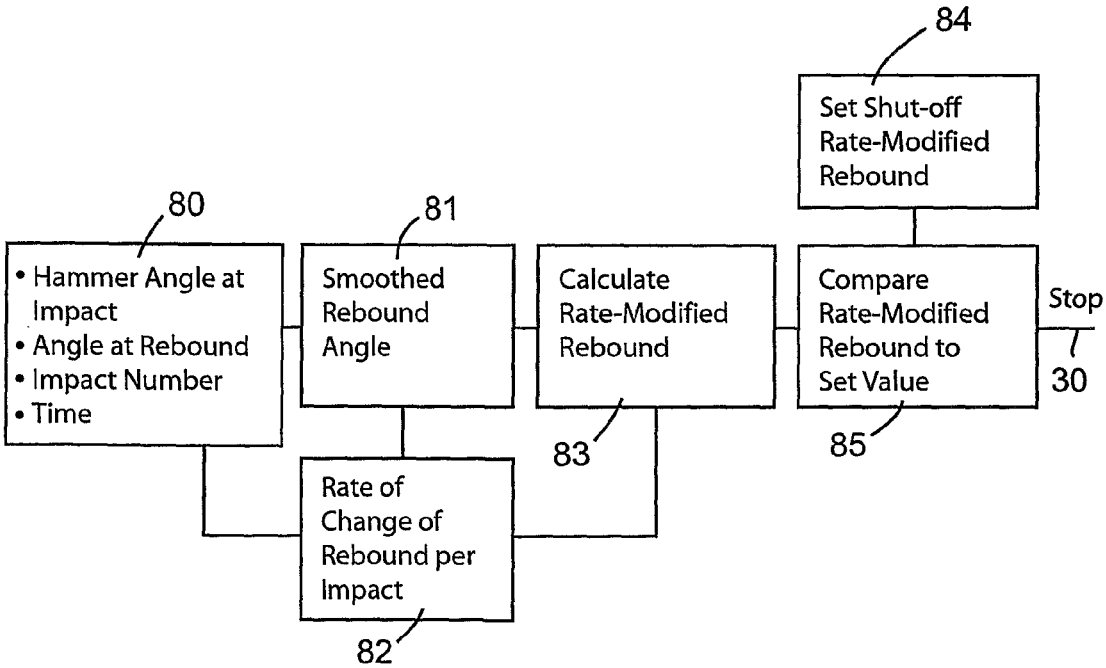
Figure 12:
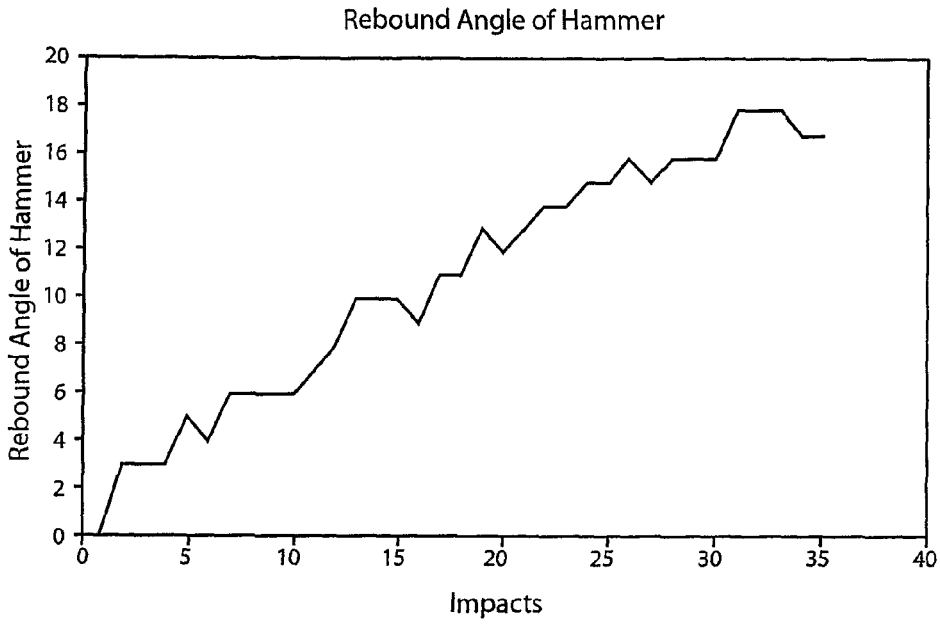
Figure 14:
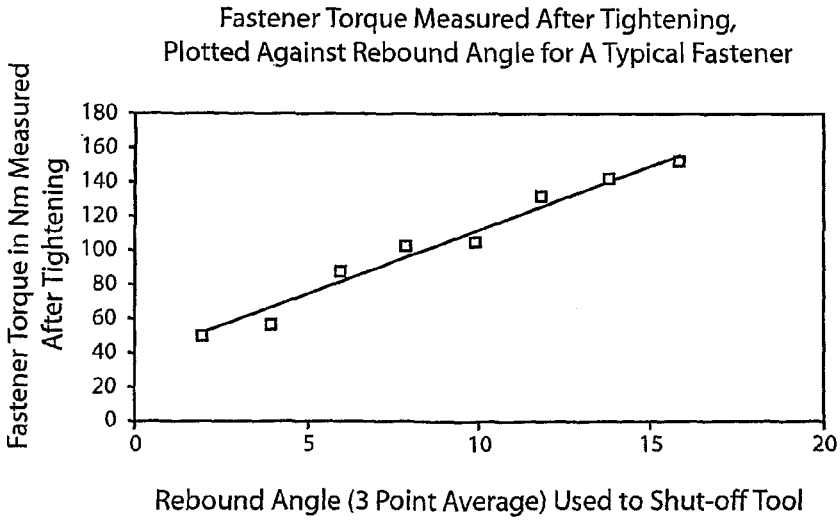

The invention will be more clearly understood from the following description of some preferred embodiments thereof, which are given by way of example only, with reference to the accompanying drawings, in which:

FIG. 1 is a transverse cross-sectional partly block representation of an impact wrench according to the invention, FIG. 2 is a block representation of apparatus also according to the invention for determining when a threaded fastener has been tightened to a predetermined level of tightness by the impact wrench of FIG. 1, FIG. 3 is a flow chart of a method according to the invention for determining when a threaded fastener has been tightened to a predetermined level of tightness by the impact wrench of FIG. 1, FIG. 4 illustrates a table showing computations explaining how smoothing of signals of the apparatus of FIG. 2 is carried out, FIG. 5 is a graphical representation of a plot of the angular displacement of a rotary hammer of the impact wrench of FIG. 1 plotted against time, FIG. 6 is an enlarged graphical representation of a plot of the angular displacement of the rotary hammer of the impact wrench of FIG. 1 plotted against time, FIG. 7 is an enlarged graphical representation of a plot of the angular displacement of the rotary hammer of the impact wrench of FIG. 1 plotted against time, FIG. 8 is a graphical representation of the angular displacement of the output shaft or anvil of the impact wrench of FIG. 1 plotted against the number of hammer impacts to which an anvil of the impact wrench has been subjected by a rotary hammer of the impact wrench, FIG. 9 is a flow chart of another method according to the invention for determining when a threaded fastener has been tightened to a predetermined level of tightness by the impact wrench of FIG. 1, FIG. 10 is a block representation of apparatus according to another embodiment of the invention for determining when a threaded fastener has been tightened to a predetermined level of tightness by an impact wrench according to another embodiment of the invention, FIG. 11 is a flowchart of a method according to the invention employed by the apparatus of FIG. 10 for determining when a threaded fastener has been tightened to a predetermined tightness level by the impact wrench of FIG. 10, FIG. 12 is a plot of the angle of rebound of the hammer resulting from each hammer impact with the anvil of the apparatus of FIG. 10 plotted against hammer impacts, FIG. 13 is a flowchart of another method according to the invention for determining when a threaded fastener has been tightened to a predetermined level of tightness, which may be employed in the apparatus of FIG. 10 by the impact wrench of FIG. 1, and FIG. 14 is a plot of torque in Newton meters measured after tightening of a fastener plotted against the rebound angles of the rotary hammer at the penultimate impact prior to which the impact wrench was deactivated using the apparatus of FIG. 10 and using a smoothing algorithm based on a moving average of the current plus the previous two rebound angles for determining the angle of rebound on each hammer impact with the anvil of the impact wrench.

Referring to the drawings, and initially to FIGS. 1 to 8 thereof, there is illustrated an impact wrench according to the invention, indicated generally by the reference numeral 1 for tightening a fastener (not shown) to a predetermined level of tightness. The impact wrench 1 comprises a housing 2 defining a hollow interior region 3, within which a drive means, namely, an electrically powered drive motor 4 is located for driving a rotary hammer 5 through an impact mechanism 7 for impacting on a rotary anvil 9. The anvil 9 is rigidly mounted on an output shaft 10, which is rotatable in a bearing 12 mounted in an opening 14 in the housing 2 for accommodating the output shaft 10 therethrough. A coupling means provided by a keyed output end 15 of the output shaft 10 is adapted for receiving a socket of an appropriate size or a screwdriver bit for engaging a threaded fastener, such as a screw or nut, for tightening or loosening thereof. The keyed end 15 of the output shaft 10 may be keyed by any suitable means, and typically, is keyed by providing the end 15 of the output shaft 10 of square transverse cross-section for engaging a bore correspondingly cross-section of a socket or screwdriver bit. In this embodiment of the invention a spring 16 is provided in the impact mechanism 7 for urging the hammer 5 is being accelerated for each impact with the anvil 9.

The impact mechanism 7, the hammer 5 and the anvil 9 are located in the hollow interior region 3 of the housing 2, and are configured so that on each full forward revolution of 360° of the hammer 5, the hammer 5 impacts twice with the anvil 9, and between each impact the hammer 5 rotates freely in a forward direction relative to the anvil 9 through a known free rotational angle while the hammer 5 is being accelerated in the forward direction by the drive motor 4 through the impact mechanism 7 to its maximum forward speed just prior to impact with the anvil 9. Since in this embodiment of the invention the hammer 5 impacts twice with the anvil 9 on each full revolution of 360° of the hammer 5, the free rotational angle of the hammer 5 relative to the anvil 9 between each impact with the anvil 9 is approximately 180°. Use will be made of this known free rotational angle of the hammer 5 relative to the anvil 9 in determining when the fastener has been tightened by the impact wrench 1 to the predetermined level of tightness, as will be described below.

In this embodiment of the invention the impact wrench 1 is battery powered by a rechargeable battery 17 which is releasably and electrically coupleable to the housing 2. Power is supplied to the drive motor 4 from the battery 17 through a relay 18 and a finger operated trigger switch 19, both of which are located in a handle portion 20 of the housing 2 of the impact wrench 1.

Up to here, the impact wrench 1 is substantially similar to a conventional impact wrench, which should be well known to those skilled in the art.

Apparatus also according to the invention and indicated generally by the reference numeral 25 is provided in the impact wrench 1 for determining when the fastener has been tightened to the predetermined level of tightness. The apparatus 25 comprises a microprocessor 26 which controls the apparatus 25 and the operation of the impact wrench 1. A monitoring means comprising a rotary encoder 27 for monitoring rotation of the hammer 5 and its angular displacement between consecutive impacts with the anvil 9 continuously outputs signals indicative of the cumulative angular position of the hammer 5. The rotary encoder comprises a proximity sensor pair 28, which is responsive to markings 29 which are provided at intervals equi-spaced circumferentially around the periphery of the hammer 5 for determining the angular position of the hammer 5, and for outputting two quadrature signals to the microprocessor 26 indicative of the angular position of the hammer 5. In this embodiment of the invention sixty markings 29 are provided around the circumferential periphery of the hammer 5, and thus using the times four capability of the two quadrature signals, the proximity sensor 28 gives an effective count of 240 counts corresponding to each 360° of rotation of the hammer 5, namely, one revolution of the hammer 5.

The microprocessor 26 reads signals from the proximity sensor 28 for determining the absolute angular position of the hammer 5 at each impact with the anvil 9. An impact between the hammer 5 and the anvil 9 is deemed to take place at the instant when the forward angular speed of the hammer 5 is at a minimum, approaches zero radians per second or reduces to zero radians per second. The forward angular speed of the hammer 5 reduces to zero radians per second when the rotational angular direction of the hammer 5 is about to reverse on impact with the anvil 9 as a result of rebound of the hammer 5 at impact. Thus, in cases where the hammer 5 rebounds on hammer impact, an impact of the hammer 5 with the anvil 9 is deemed to have taken place when the forward angular speed of the hammer 5 reduces to zero radians per second, is at a minimum or is approaching zero radians per second just before the direction of angular rotation of the hammer 5 reverses due to rebound of the hammer on impact. In cases where the hammer 5 does not rebound on impact with the anvil, the forward angular speed of the hammer 5 may not reduce to zero radians per second on impact, and in such cases an impact between the hammer 5 and the anvil 9 is deemed to have taken place at the instant when the forward angular speed of the hammer 5 reduces to a minimum or approaches zero radians per second.

Accordingly, the microprocessor 26 is programmed to compute the angular speed of the hammer 5 from the signals continuously read from the proximity sensor 28. On each determination by the microprocessor 26 that the forward angular speed of the hammer 5 is zero radians per second, at a minimum or approaching zero radians per second, the microprocessor 26 also determines the cumulative angular displacement of the hammer 5, which is the cumulative angular displacement of the hammer 5 on each hammer impact. In this embodiment of the invention the microprocessor 26 determines the cumulative angular displacement of the hammer 5 from the first detected hammer impact, and records the cumulative angular displacement of the hammer 5 against the corresponding hammer impact. Since the angular position of the anvil 9 at each hammer impact is the angular position to which the anvil 9 is advanced by the hammer impact, the cumulative angular displacement of the anvil 9 after each hammer impact can be determined from the cumulative angular displacement of the hammer 5 at the corresponding hammer impact.

In this embodiment of the invention the fastener is deemed to be tightened to the predetermined tightness level when the number of hammer impacts required to advance the anvil 9 through a predetermined angle exceeds a predetermined number of hammer impacts. In this embodiment of the invention the predetermined angle is 1.5°. In this embodiment of the invention an angular displacement of 1.5° is equal to a unit count of the counts outputted by the proximity sensor 28, due to the fact that the rotary encoder gives a count of 240 for each 360° rotation of the hammer 5. The microprocessor 26 is programmed to derive the cumulative angular displacement of the anvil 9 on each hammer impact from the first detected hammer impact from the corresponding cumulative angular displacement of the hammer 5 by computing the difference between the cumulative angular displacement of the hammer 5 after the corresponding hammer impact and the cumulative angular displacement of the hammer after the immediately previous hammer impact and subtracting the free rotational angle of the hammer 5 relative to the anvil 9 between each hammer impact, which in this case is 180° from the computed difference. The result gives the angle by which the anvil 9 is advanced by the corresponding hammer impact, in other words, the angle by which the anvil 9 is displaced by the corresponding hammer impact. This result is then added to the immediately previously computed cumulative angular displacement of the anvil 9. The microprocessor 26 then computes the reciprocal of the angle by which the anvil 9 is advanced on each hammer impact which gives, the number of hammer impacts required to advance the anvil 9 through the predetermined angle, namely, 1.5°, and the number of hammer impacts required to advance the anvil through the predetermined angle corresponding to each hammer impact is stored and cross-referenced with the number of the corresponding hammer impact from the first detected hammer impact. These computations are described in more detail below.

The microprocessor 26 compares each of the obtained values of the number of hammer impacts required to advance the anvil 9 through the predetermined angle on each hammer impact with the predetermined number of hammer impacts which has already been entered and stored in the microprocessor 26. On the number of hammer impacts required to advance the anvil through the predetermined unit angle exceeding the predetermined number of hammer impacts, the microprocessor 26 outputs a deactivating signal on a line 30 to the relay 18 for operating the relay 18 in an open circuit state in order to isolate the drive motor 4 from the battery 17, thereby deactivating the impact wrench 1.

Referring now to FIG. 2, there is illustrated a block representation of the impact wrench 1, and FIG. 2 in particular illustrates the operation of the microprocessor 26 in determining when the number of hammer impacts required to advance the anvil 9 through the predetermined angle exceeds the predetermined number of hammer impacts. The predetermined number of hammer impacts, which is selectable per predetermined angle of displacement of the anvil 9 is entered into the microprocessor 26 through an input interface 33, and its selection is dependent on the tightness to which the fastener is to be tightened. Initially on operating the trigger switch 19 the relay 18 is operated in the closed circuit state to power the drive motor 4. Until the fastener puts up resistance to rotation, the hammer 5 rotates the anvil 9 forwardly continuously, thereby continuously rotating the fastener. On resistance to rotation by the fastener being encountered, the impact wrench 1 commences to operate in impact mode. This operation of the impact wrench 1 can be seen from the plot of the angular displacement of the hammer 5 against time of FIG. 5, where the hammer 5 and the output shaft 10 rotate continuously up to the point A of the waveform, and thereafter the hammer 5 impacts with the anvil 9 twice per revolution of the hammer 5.

Block 35 reads signals from the proximity sensor 28 of the rotary encoder 27 for continuously determining the cumulative angular displacement of the hammer 5 from the first detected hammer impact. Block 36 reads signals from a timer 37 and from the block 35 and determines the angular speed of the hammer 5. Block 38 determines if the forward angular speed of the hammer 5 is zero radians per second, at a minimum or approaching zero radians per second just prior to the direction of the angular rotation of the hammer 5 reversing due to rebound as a result of a hammer impact, and if the hammer does not rebound, block 38 determines if the forward angular speed of the hammer 5 is zero radians per second, at a minimum or approaching zero radians per second. If block 38 determines that the forward angular speed of the hammer 5 is zero radians per second, at a minimum or approaching zero radians per second, block 39 reads the cumulative angular displacement of the hammer 5 from the first detected hammer impact from block 35 at the instant the angular speed of the hammer 5 is zero radians per second, at a minimum or approaching zero radians on each consecutive hammer impact. Block 39 also computes the cumulative angular displacement of the anvil 9 on each consecutive hammer impact from the first detected hammer impact.

As mentioned above, the cumulative angular displacement of the anvil 9 on each hammer impact is determined by computing the difference between the cumulative angular displacement of the hammer 5 after the corresponding hammer impact and the cumulative angular displacement of the hammer 5 after the immediately previous hammer impact, and subtracting the free rotational angle of 180° from the computed difference. The result is added to the cumulative angular displacement of the anvil 9 after the immediately previous hammer impact. The cumulative angular displacements of the anvil 9 from the first detected hammer impact determined by block 39 are stored by block 40 in memory in the microprocessor 26 and are cross-referenced with the corresponding numbers of the respective hammer impacts, which are numbered consecutively from the first detected hammer impact. Block 41 determines the angle by which the anvil 9 is advanced on each hammer impact and computes the corresponding reciprocal of the angle by which the anvil 9 is advanced on the corresponding hammer impact in order to obtain the number of hammer impacts required to advance the anvil 9 through the predetermined angle on each hammer impact.

Block 41 also reads the predetermined number of hammer impacts required to advance the anvil through the predetermined angle which has already been loaded into block 42, and compares the computed number of hammer impacts required to advance the anvil through the predetermined angle with the predetermined number of hammer impacts read from block 42. If the computed number of hammer impacts required to advance the anvil 9 through the predetermined angle exceeds the predetermined number of hammer impacts, block 41 outputs the deactivating signal on the line 30 to the relay 18 for operating the relay 18 in the open circuit state for deactivating the impact wrench 1. Block 41 also outputs signals to a display 43 for indicating on a display of the impact wrench 1 that the fastener has been tightened to the predetermined tightness level.

In order to minimise the effect of noise in signals received from the rotary encoder 27, block 41 applies a smoothing algorithm when computing the number of hammer impacts required to advance the anvil 9 through the predetermined angle on each hammer impact, as will be described in detail below with reference to FIG. 4.

Block 44 compares the maximum forward angular speed of the hammer 5 just prior to impact with the anvil 9 with a predetermined minimum angular speed value, and if the maximum forward angular speed of the hammer 5 just prior to impact fails to reach the predetermined minimum angular speed value, block 44 outputs a low speed alert signal to block 45, which causes block 45 to sound an alarm to indicate that because of the forward angular speed of the hammer 5 just prior to impact, the apparatus 25 may not be able to accurately determine when the fastener has been tightened to the predetermined tightness level by the impact wrench 1. Inadequate angular speed of the hammer 5 prior to a hammer impact may result from a low battery. Additionally, block 44 compares the maximum forward angular speed of the hammer 5 just prior to impact with the anvil 9 with a predetermined maximum angular speed value, and if block 44 determines that the maximum forward angular speed of the hammer 5 exceeds the predetermined maximum angular speed value, block 44 outputs a high speed alert signal to block 45, which causes block 45 to sound an alarm to indicate that the forward angular speed of the hammer 5 just prior to impact is such that it could result in over-tightening of the fastener.

Additionally, the microprocessor 26 is programmed to alter the stored number of predetermined number of hammer impacts per predetermined angle which corresponds to the fastener being tightened to the predetermined tightness level and which is stored in block 42 in response to variation in the maximum forward angular speed of the hammer 5 just prior to hammer impact. By varying the predetermined number of hammer impacts stored in block 42 to advance the anvil through the predetermined angle which corresponds to the fastener being tightened to the predetermined tightness level in response to a change in the maximum forward angular speed of the hammer just prior to hammer impact, the accuracy of tightening of the fastener to the predetermined tightness level is enhanced. By way of explanation, the kinetic energy of the hammer 5 is at a maximum just prior to impact of the hammer 5 with the anvil 9, and is a function of the maximum forward angular speed of the hammer 5. The energy of the hammer 5, and hence the maximum forward angular speed of the hammer 5 is a fundamental parameter in tightening a fastener to a predetermined tightness level with an impact wrench. Ideally, the maximum forward angular speed of the hammer should be constant during tightening of the fastener when the impact wrench is operating in impact mode. However, variations in motor output through battery conditions may cause the maximum forward angular speed of the hammer to vary over time. Such variation in maximum forward angular speed of the hammer causes the elapsed time between impacts to vary. Thus, by varying the number of hammer impacts stored in block 42 which are required to advance the anvil through the predetermined angle in response to variations in the maximum forward angular speed of the hammer, account is taken of variations in the maximum forward angular speed of the hammer 5 just prior to impact. In order to achieve this, block 44 compares the maximum forward angular speed of the hammer 5 just prior to impact with a predetermined acceptable angular speed value, which corresponds to the stored predetermined number of hammer impacts to advance the anvil through the predetermined angle. If block 44 determines that the maximum forward angular speed of the hammer increases or decreases above or below the predetermined acceptable angular speed value, block 44 appropriately alters the predetermined number of hammer impacts stored in block 42 in response to variation in the maximum forward angular speed of the hammer 5 from the predetermined acceptable angular speed value. If the maximum forward angular speed of the hammer 5 increases above the predetermined acceptable angular speed value, the predetermined number of hammer impacts stored in block 42 is decreased, and vice versa if the maximum forward angular speed of the hammer 5 decreases below the predetermined acceptable angular speed value. Alternatively, instead of varying the predetermined number of hammer impacts stored in block 42 in response to the predetermined maximum forward angular speed of the hammer 5 just prior to impact increasing or decreasing above or below the predetermined acceptable angular speed value, the predetermined number of hammer impacts stored in block 42 required to advance the anvil through the predetermined angle may be varied only after the maximum forward angular speed of the hammer 5 exceeds the predetermined maximum angular speed value or fails to reach the predetermined minimum angular speed value. The amount by which the predetermined number of hammer impacts stored in block 42 to advance the anvil 9 through the predetermined angle is determined by an algorithm, which may be derived mathematically or empirically.

Referring now to FIG. 4, the smoothing algorithm which is applied by block 41 in computing the number of hammer impacts required to advance the anvil 9 through the predetermined angle on each hammer impact will now be described. Column A of the table of FIG. 4 records the number of impacts of the hammer 5 with the anvil 9. The first detected hammer impact is recorded as the impact A1, the second hammer impact is recorded as the impact A2, and so on. However, for convenience, only five hammer impacts up to hammer impact number A5 are shown in the table. Column C of Table 4 records the cumulative angle of displacement of the anvil 9 on each hammer impact from the first detected hammer impact, namely, the hammer impact A1, which is computed by block 39 of FIG. 2. C1 in column C represents the cumulative angular displacement of the anvil 9 at the first hammer impact, which is recorded as zero angle. C2 in column C represents the cumulative angular displacement of the anvil 9 from the first hammer impact A1 to the second hammer impact A2, while C3 in column C represents the cumulative angular displacement of the anvil 9 from the first hammer impact A1 to the third hammer impact A3, and so on. In order to smooth the computation of the cumulative angular displacement of the anvil 9 from the first hammer impact A1 to each subsequent hammer impact, a moving average of the cumulative angular displacement of the anvil 9 from the first hammer impact A1 to each subsequent hammer impact is computed and is recorded in column D. In this embodiment of the invention the last two computed cumulative angular displacements of the anvil 9 computed on the corresponding two consecutive hammer impacts are averaged for determining the cumulative angular displacement of the anvil 9 from the first detected hammer impact to the second of the two hammer impacts.

Accordingly, the smoothed cumulative angular displacement $D_n$ of the anvil 9 at each hammer impact $A_n$ is given by the equation:

$$D_n = \frac{C_n + C_{(n-1)}}{2}$$

where $C_n$ is the cumulative angular displacement of the anvil 9 after hammer impact $A_n$, and $C_{(n-1)}$ is the cumulative angular displacement of the anvil 9 after the hammer impact $A_{(n-1)}$.

Thus, at the second hammer impact the cumulative angular displacement of the anvil 9 from the first hammer impact is given by the equation:

$$D2 = \frac{(C2 + C1)}{2}$$

At the third hammer impact the cumulative angular displacement of the anvil 9 from the first hammer impact is given by the equation:

$$D3 = \frac{(C3 + C2)}{2}$$

and so on for the cumulative angular displacement of the anvil 9 at the respective hammer impacts.

After computing each smoothed cumulative angular displacement of the anvil 9 at each hammer impact, the number of hammer impacts per predetermined angle of angular rotation of the anvil 9 required at each hammer impact is then computed from the smoothed cumulative angular displacements of the anvil 9 in column D. However, in computing the number of hammer impacts required to advance the anvil 9 through the predetermined angle on each hammer impact, further smoothing is applied by using a two chord derivative in accordance with the following equation:

$$F_n = \frac{A_n - A_{(n-2)}}{D_n - D_{(n-2)}}$$

where $F_n$ is the two chord derivative of the number of hammer impacts required to advance the anvil 9 through the predetermined angle at the hammer impact $A_n$, $A_n$ is the number of the hammer impact from the first detected hammer impact at which the chord derivative is being determined, $A_{(n-2)}$ is the number of the hammer impact two hammer impacts prior to the hammer impact $A_n$, $D_n$ is the smoothed cumulative angular displacement of the anvil 9 on hammer impact number $A_n$, and $D_{(n-2)}$ is the smoothed cumulative angular displacement of the anvil 9 corresponding to hammer impact $A_{(n-2)}$.

The two chord derivative computed at each hammer impact is recorded in column F of the table of FIG. 4.

Further smoothing is carried out by integrating the two chord derivative of the number of hammer impacts required to advance the anvil 9 through the predetermined angle for each hammer impact already computed in column F. The integration of the two chord derivative of the number of hammer impacts required to advance the anvil 9 through the predetermined angle on each hammer impact is computed from the following equation:

$$J_n = J_{(n-1)} + F_n$$

where $J_n$ is the integral of the two chord derivative of the number of hammer impacts required to advance the anvil 9 through the predetermined angle corresponding to hammer impact number $A_n$, and $J_{(n-1)}$ is the previously computed integral of the two chord derivative of the number of hammer impacts required to advance the anvil 9 through the predetermined angle corresponding to the previous hammer impact.

The integral of the two chord derivative computed at each hammer impact is recorded in column J of the table of FIG. 4.

The integral of the two chord derivative of the number of hammer impacts required to advance the anvil 9 through the predetermined angle is then averaged and recorded in column K of the table of FIG. 4. The average of the integral of the two chord derivative of the number of hammer impacts required to advance the anvil 9 through the predetermined angle at each hammer impact is given by the equation:

$$K_n = \frac{J_n}{A_n}$$

where $K_n$ is the average of the integrated two chord derivative of the number of hammer impacts required to advance the anvil 9 through the predetermined angle computed at hammer impact $A_n$, and $J_n$ and $A_n$ represent the values already set out.

Referring now to FIG. 3, a flowchart of the computations carried out by the microprocessor 26 in determining the smoothed value of the number of hammer impacts required to advance the anvil 9 through the predetermined angle at each hammer impact is illustrated. In block 50 the smoothed cumulative angular displacement of the anvil 9 at each hammer impact is computed and stored against the corresponding number of the hammer impact, and the time of the hammer impact is also recorded. Block 51 then computes the average angle through which the anvil 9 is advanced over n hammer impacts. Block 52 then computes the number of hammer impacts required to advance the anvil 9 through the predetermined angle at each hammer impact based on the computations from block 51. Block 53 compares the computed value of the number of hammer impacts required to advance the anvil 9 through the predetermined angle which has been computed by block 52 with the predetermined number of hammer impacts which has been read by block 54 from the stored value in the memory of the microprocessor 26, and if the number of hammer impacts required to advance the anvil 9 through the predetermined angle computed by block 52 exceeds the predetermined number of hammer impacts read by block 54, block 53 outputs the deactivating signal on line 30 for operating the relay 18 in the open circuit state for deactivating the impact wrench 1.

Referring now to FIG. 5, as mentioned above, a waveform representing a plot of the cumulative angular displacement of the hammer 5 of the impact wrench 1 against time is illustrated. As can be seen, up to approximately time 0.6 seconds the hammer 5 rotates continuously. This is up to point A on the waveform. The first impact of the hammer 5 with the anvil 9 occurs at time approximately 0.6 seconds, and thereafter, as can be seen, the impact wrench 1 operates in impact mode where the impacts of the hammer 5 with the anvil 9 are illustrated by the saw-tooth effect of the waveform.

FIGS. 6 and 7 illustrate waveforms which represent plots of the cumulative angular displacement of the hammer 5 of the impact wrench 1 against time in seconds. As can be seen in FIG. 6, during the time period from time 0.600 seconds to 0.660 seconds, three impacts between the hammer 5 and the anvil 9 have occurred. Similarly, in FIG. 7 three impacts of the hammer 5 with the anvil 9 have occurred from time approximately 1.885 seconds to 1.945 seconds. In FIG. 6 the fastener torque level is relatively low, while in FIG. 7 the fastener torque level is considerably higher than that of FIG. 6. However, both illustrate how the hammer 5 is brought to a halt on impact with the anvil 9 and then accelerates again. At the higher torque level of FIG. 7 the hammer 5 not only stops but briefly reverses direction before accelerating forward for the next impact with the anvil 9, in other words, the hammer 5 rebounds through a rebound angle on impact with the anvil 9. Thus, the hammer 5 approaches the impact point with a high forward speed, then stops and under increasing torque resistance from the fastener attains negative velocity that results in a rebound of the hammer 5. Eventually, this negative velocity is again reduced to zero as the impact mechanism accelerates the hammer 5 forwardly again to its maximum forward angular speed before the next impact with the anvil 9. As will be described below with reference to FIGS. 10 to 14, apparatus similar to the apparatus 25 is programmed to determine when a fastener has been tightened to a predetermined level of tightness based on the reversal of speed and the angle of rebound of the hammer 5.

Referring now to FIG. 8, a plot of the cumulative angular displacement of the anvil 9 of the impact wrench 1 plotted against the number of hammer impacts to which the anvil 9 is subjected is illustrated. As can be seen, the angular displacement of the anvil 9 increases relatively steeply during the first ten hammer impacts or so. Thereafter the angular displacement of the anvil 9 falls off rapidly as the number of hammer impacts to which the anvil 9 is subjected increases. Thus, this shows that by determining the number of hammer impacts to advance the anvil 9 through a predetermined angle, a relatively accurate value of the level of tightness to which the fastener has been tightened can be derived.

While in FIG. 1 the apparatus 25 for determining when the fastener has been tightened by the impact wrench 1 to the predetermined level of tightness has been illustrated as being mounted externally on the housing 2 of the impact wrench 1, it will be readily apparent to those skilled in the art that in a production model of the impact wrench, the apparatus 25 will be mounted within the housing 2. Although in certain cases it is envisaged that the apparatus may be located remotely of the apparatus to minimise the effects of vibrations on the apparatus resulting from the hammer impacts with the anvil.

Referring now to FIG. 9, there is illustrated a flowchart of an alternative mode of operation of the microprocessor 26 in determining when the fastener has been tightened by the impact wrench 1 to the predetermined level of tightness. In this embodiment of the invention the microprocessor 26 is programmed to determine when the fastener has been tightened to a predetermined level of tightness based on the total angle through which the anvil 9 is advanced from the first detected hammer impact, and the angular position of the anvil 9 is determined from the angular position of the hammer 5 as described with reference to the apparatus 25 of FIGS. 1 to 8.

Block 60 of FIG. 9 is similar to block 50 of FIG. 3 and determines the smoothed cumulative angular displacement of the anvil 9 on each hammer impact as set out in column D of FIG. 4. The cumulative angular displacement of the anvil 9 on each hammer impact is stored against the corresponding number of the hammer impact, and the time at which the hammer impact occurred is recorded. Block 61 computes from block 60 the angle through which the anvil 9 has advanced from the first detected hammer impact. Block 61 determines the total angle through which the anvil 9 has been advanced from the first hammer impact from the smoothed cumulative angular displacement computed by block 60. Block 62 compares the total angle advanced by the anvil 9 since the first detected hammer impact with a predetermined total angle of advance which is entered and stored in memory of the microprocessor 26 and read by block 63. On block 62 determining that the total angle advanced by the anvil 9 from the first detected hammer impact exceeds the predetermined total angle, block 62 outputs the deactivating signal on line 30 to the relay 18 for operating the relay 18 in the open circuit state for deactivating the impact wrench 1.

Additionally, in this embodiment of the invention the microprocessor 26 is programmed to determine the maximum forward angular speed of the hammer 5 just prior to impact with predetermined minimum and maximum angular speed values, and if the maximum forward angular speed of the hammer 5 just prior to impact fails to reach the predetermined minimum angular speed value or exceeds the predetermined maximum angular speed value, appropriate low speed or high speed alert signals are outputted, as described with reference to the apparatus 25 of the impact wrench 1 of FIGS. 1 to 8. Further, the microprocessor 26 of the apparatus of this embodiment of the invention may also be programmed to compare the maximum forward angular speed of the hammer 5 just prior to impact with a predetermined acceptable angular speed value, and if the maximum forward angular speed of the hammer just prior to impact varies from the predetermined acceptable angular speed value, the predetermined total angle of advance which corresponds to the fastener being tightened to the desired level of tightness is appropriately varied in response to variation of the maximum forward angular speed of the hammer 5 just prior to impact.

While in the flowchart of FIG. 9 block 61 computes the total angle through which the anvil 9 is advanced from the first detected hammer impact, and block 62 compares this total angle with a stored predetermined total angle, it is envisaged in certain cases that block 61 instead of computing the total angle advanced by the anvil from the first detected hammer impact could alternatively compute the number of hammer impacts from the first detected hammer impact, and then block 62 would compare the total number of hammer impacts computed by block 61 with a predetermined stored number of hammer impacts, which would be read by block 63, and in the event of the total number of hammer impacts computed by block 61 exceeding the predetermined number of hammer impacts, block 62 would then output the deactivating signal on the line 30 for deactivating the impact wrench.

While in the embodiment of the invention described with reference to FIGS. 1 to 8 the microprocessor 26 is programmed to determine the number of hammer impacts required to advance the anvil 9 through the predetermined angle at each hammer impact for determining when the fastener has been tightened to the predetermined level of tightness, it is envisaged that instead of determining the number of hammer impacts required to advance the anvil 9 through the predetermined angle on each hammer impact, the level of tightness could be determined based on the angle through which the anvil 9 is advanced at each hammer impact, which is in fact the reciprocal of the number of hammer impacts required to advance the anvil 9 through the predetermined angle on each hammer impact. Needless to say, if the determination of the level of tightness to which the fastener is tightened is based on a determination of the angle through which the anvil 9 is advanced on each hammer impact, similar smoothing would be applied when determining the angle through which the anvil 9 is advanced at each hammer impact as has already been described with reference to FIGS. 3 and 4.

Referring now to FIGS. 10 to 14, there is illustrated apparatus according to another embodiment of the invention, indicated generally by the reference numeral 70, for use in an impact wrench, similar to the impact wrench 1 for determining when a fastener has been tightened to a predetermined tightness level. The apparatus 70 is substantially similar to the apparatus 25, and similar components are identified and referred to by the same reference numerals. The apparatus 70 also comprises a microprocessor similar to the microprocessor 26, an interface unit 33 for entering data regarding predetermined values into the microprocessor 26, and a rotary encoder similar to the rotary encoder 27 which monitors the angular displacement and the rotational speed of the hammer 5. However, in this embodiment of the invention the method for determining when the fastener has been tightened to the predetermined tightness level is determined based on the angle of rebound of the hammer 5 resulting from each impact of the hammer 5 with the anvil 9.

It has been found that there is a relationship between the angle of rebound of the hammer 5 on each impact with the anvil 9 and the level to which the fastener has been tightened. It has been found that as the fastener is approaching the desired level of tightness, the angle of rebound increases with each hammer impact. Referring to FIG. 12, a plot of the angle of rebound of the hammer 5 at each hammer impact plotted against the number of the hammer impacts is illustrated, and as can be seen, the angle of rebound of the hammer gradually increases as the number of the hammer impact increases.

Accordingly, referring now to FIG. 10, there is illustrated a block representation of the apparatus 70 and its operation, which is somewhat similar to the block representation of FIG. 2, and similar blocks are identified by the same reference numerals. In this embodiment of the invention in order to determine the rebound angle of the hammer 5 on each impact with the anvil 9, it is necessary to determine two points in the angular displacement of the hammer 5 at which the angular speed of the hammer 5 is zero radians per second, at a minimum or approaching zero radians per second just prior to a change in the direction of angular displacement of the hammer 5 for each hammer impact. Thus, on each hammer impact the cumulative angular displacement of the hammer 5 is determined at the instant of impact with the anvil 9 as already described with reference to the apparatus 25. In other words, that cumulative angular displacement of the hammer 5 is determined when the forward rotational speed of the hammer 5 reduces to zero radians per second, is at a minimum value or is approaching zero radians per second just prior to the direction of rotation of the hammer 5 reversing at impact as a result of rebound.

The rebound angle is then determined by determining the cumulative angular displacement of the hammer 5 after the hammer 5 has rebounded, and subtracting this cumulative angular displacement of the hammer 5 after rebound from the cumulative angular displacement of the hammer 5 on impact with the anvil 9. The cumulative angular displacement of the hammer 5 on completion of rebound is determined by detecting the rotational speed of the hammer, and determining the cumulative angular displacement of the hammer 5 at rebound at the instant the rearward rotational speed of the hammer 5 reduces to zero radians per second, is at a minimum or approaching zero radians per second just before the hammer 5 again changes direction and commences to accelerate in the forward rotational direction for the next hammer impact.

After block 38 has determined that the angular speed of the hammer 5 is zero radians per second, at a minimum or approaching zero radians per second just prior to the direction of angular rotation of the hammer 5 reversing, block 39 reads the cumulative angular displacement of the hammer 5 from the rotary encoder 27. Block 38 also determines if the direction of angular rotation of the hammer 5 reverses as a result of rebound, and determines the instance at which the rearward angular speed of the hammer 5 reduces zero radians per second, is at a minimum or is approaching zero radians per second after the impact and just prior to the direction of angular rotation of the hammer 5 again changing as the hammer 5 commences to accelerate in the forward direction for the next hammer impact. Block 39 also records the cumulative angular displacement of the hammer 5 at the end of rebound of the hammer 5 when the rearward angular speed of the hammer 5 reduces to zero radians per second, is at a minimum or is approaching zero radians per second. Block 71 then computes the angle of rebound of the hammer 5 by subtracting the cumulative angular displacement of the hammer 5 at the end of rebound of the hammer 5 from the cumulative angular displacement of the hammer 5 at the instant of impact with the anvil 9 for that hammer impact. The computed angles of rebound of the hammer 5 are stored in memory in block 72 and cross-referenced with the corresponding hammer impacts, which are numbered consecutively from the first detected hammer impact.

As each angle of rebound of the hammer 5 is computed, block 41 in this embodiment of the invention compares the just computed angle of rebound with a predetermined angle of rebound. The selected predetermined angle of rebound would already have been entered and stored in memory in the microprocessor 26 and loaded into block 42. The predetermined angle of rebound is the angle of rebound which corresponds to the fastener being tightened to the predetermined tightness level. On block 41 determining that the just computed angle of rebound of the hammer 5 exceeds the predetermined angle of rebound, block 41 outputs the deactivating signal on the line 30, and also outputs a signal to the display 43 indicating that the fastener has been tightened to the desired tightness level.

In this embodiment of the invention in order to minimise the effect of noise, a smoothing algorithm is applied as the angles of rebound are computed, and in this embodiment of the invention the smoothing algorithm is based on determining a moving average of the angles of rebound, which in this case requires averaging the currently computed angle of rebound and the previous two computed and averaged angles of rebound resulting from the immediately previous two consecutive hammer impacts.

The flowchart of FIG. 11 is substantially similar to the flowchart of FIG. 2, with the exception that instead of comparing the number of hammer impacts per predetermined angle of displacement of the anvil with a predetermined number of hammer impacts, the angle of rebound of the hammer on each hammer impact is compared with the predetermined angle of rebound. Thus, block 75 computes the angle of rebound of the hammer 5 on each hammer impact and records the angle of rebound of the hammer 5 against the number of the hammer impact from the first detected hammer impact and the time of the hammer impact. Block 76 applies the smoothing algorithm to the computed angles of rebound by determining the moving average of the current angle of rebound and the immediately previous two consecutive angles of rebound. Block 77 compares the currently computed smoothed angle of rebound of the hammer 5 with the selected predetermined angle of rebound, which has already been entered into the microprocessor 27 by block 78, and on the currently computed smoothed angle of rebound exceeding the predetermined angle of rebound, the deactivating signal is outputted on line 30 by block 76 for deactivating the impact wrench.

Otherwise, the apparatus 70 according to this embodiment of the invention is similar to the apparatus 25, and its use and incorporation in an impact wrench is similar to that described with reference to the impact wrench 1 of FIGS. 1 to 8.

Referring now to FIG. 13, there is illustrated a flowchart of an alternative method of using the apparatus 70 for determining when the fastener has been tightened by the impact wrench to a predetermined level of tightness. It has been found that the rebound angle is affected by the rate of tightening of the fastener by the impact wrench. In this embodiment of the invention to take account of the effect of the rate of tightening of the fastener on the angle of rebound of the hammer, the angle of rebound computed on each hammer impact is weighted by the rate of change of the angle of rebound.

Referring to FIG. 14, a plot of the fastening torque measured in Newton meters to which similar fasteners have been tightened by the impact wrench according to this embodiment of the invention is plotted against the angle of rebound based on the smoothed moving average of the angle of rebound. As can be seen, the torque achieved in the fastener increases approximately linearly with angle of rebound.

From FIG. 14 it can be seen that the torque or tightness to which the fasteners are tightened varied with joint stiffness. With a stiffer joint, that is, one in which the fastener tightens to a given torque with less turn, the rebound is greater for a given fastener torque. If, therefore, the predetermined angle of rebound is selected to be the same for stiff joints as for less stiff joints, the fasteners of stiffer joints will be tightened to a higher torque than the fasteners of less stiff or softer joints. In many cases where the joint is consistent, the use of a constant predetermined rebound angle for fasteners of such consistent joints is adequate, and each fastener of the consistent joint should be tightened to substantially the same torque. However, where the joint varies in stiffness, weighting the computed angle of rebound with the rate of change of the angle of rebound gives a more consistent result.

Referring again to FIG. 13, block 80, which is similar to block 75 of FIG. 11, determines the angle of rebound of the hammer on each hammer impact with the anvil 9 and records the rebound angle against the number of the hammer impact from the first detected hammer impact, and the time of the hammer impact. Block 81 is similar to block 76, and computes the smoothed angle of rebound. Block 82 determines the rate of change of the rebound angle on each hammer impact from the immediately previous hammer impact. Block 82 may determine the rate of change of the angle of rebound of the hammer 5 from the angles of rebound determined by block 80 or from the smoothed angles of rebound computed by block 81. Block 83 combines the smoothed angle of rebound of the hammer 5 just computed by block 81 with the corresponding just computed rate of change of the angle of rebound of the hammer 5 to produce a rate modified smoothed angle of rebound which is weighted to take account of the effect of the rate of tightening of the fastener on the angle of rebound. The rate modified smoothed angle of rebound is higher if the rate of change of the angle of rebound is higher. Block 84 reads the stored predetermined angle of rebound from the microprocessor 26 and computes a corresponding rate modified predetermined angle of rebound, which is then stored in block 84. Block 85 compares the rate modified smoothed angle of rebound computed by block 83 with the rate modified predetermined stored angle of rebound which is stored in block 84, and if the computed rate modified angle of rebound exceeds the stored predetermined value in block 84, block 85 outputs the deactivating signal on the line 30 for deactivating the impact wrench.

Additionally, in the embodiments of the invention described with reference to FIGS. 10 to 14 the microprocessor 26 may be programmed to determine the maximum forward angular speed of the hammer 5 just prior to impact with predetermined minimum and maximum angular speed values, and if the maximum forward angular speed of the hammer 5 just prior to impact fails to reach the predetermined minimum angular speed value or exceeds the predetermined maximum angular speed value, appropriate low speed or high speed alert signals may be outputted, as described with reference to the apparatus 25 of the impact wrench 1 of FIGS. 1 to 8. Further, the microprocessor 26 of the apparatus of these embodiments of the invention may also be programmed to compare the maximum forward angular speed of the hammer 5 just prior to impact with a predetermined acceptable angular speed value, and if the maximum forward angular speed of the hammer just prior to impact varies from the predetermined acceptable angular speed value, the predetermined total angle of advance which corresponds to the fastener being tightened to the desired level of tightness is appropriately varied in response to variation of the maximum forward angular speed of the hammer 5 just prior to impact.

Otherwise, operation of the apparatus according to this embodiment of the invention is substantially similar to the apparatus 70.

While in the impact wrenches described with reference to FIGS. 1 to 14, the cumulative angular displacement through which the anvil 9 is advanced on each hammer impact has been determined and derived from the cumulative angular displacement of the hammer 5 on each impact from the first detected impact, it is envisaged in certain cases that the cumulative angular displacement of the anvil 9 on each hammer impact may be directly determined from a rotary encoder which would be operably coupled to the anvil or the output shaft of the impact wrench for directly determining the cumulative angular displacement of the anvil 9 on each hammer impact.

It is envisaged that while a number of embodiments of the apparatus according to the invention have been described whereby in one embodiment of the invention the determination as to when the fastener has been tightened to a predetermined tightness level is based on the number of hammer impacts per predetermined angle of displacement of the anvil 9, and in another embodiment of the invention the determination as to when the fastener has been tightened to a predetermined tightness level has been based on the angle of rebound of the hammer, and in a further embodiment of the invention the determination as to when the fastener has been tightened to the predetermined tightness level is based on the angle of rebound of the hammer weighted by the rate of change of the angle of rebound, in certain cases, it is envisaged that the apparatus may determine when the fastener has been tightened to a predetermined tightness level using two or more of these bases, in other words, the apparatus would be programmed to determine when the fastener has been tightened to the predetermined tightness level based on the number of hammer impacts per predetermined angle of displacement of the anvil, the angle of rebound of the hammer and the angle of rebound of the hammer weighted by the rate of change of the angle of rebound. In which case, it is envisaged that the accuracy of determination of the fastener being tightened to the predetermined tightness level would be even more accurate than relying on either one of the methods separately.

Alternatively, it will be appreciated that apparatus according to the invention may rely on only two of the methods for determining when the fastener has been tightened to the predetermined tightness level, for example, the apparatus may rely on either of any two of the three methods, namely, determining the number of hammer impacts required per predetermined angle of displacement of the anvil, the angle of rebound of the hammer and the angle of rebound of the hammer weighted by the rate of change of the angle of rebound.

Tightening a fastener with an impact wrench requires energy transfer from the hammer to the anvil, and then to the fastener and the structure supporting it. A portion of the hammer energy is lost in several ways: in the impact process, in the rebound of the hammer and absorbed by the structure supporting the fastener. These energy losses increase as the fastener becomes tighter. Thus, a declining percentage of the hammer energy goes into fastener tightening as torque increases. The measurements and calculations disclosed herein provide a means to measure the hammer energy by measuring the speed of the hammer, the maximum speed of the hammer, a means to measure some of the lost energy by the rebound of the hammer and a means to measure the fastener torque resistance to the remaining energy transferred to the fastener through the number of hammer impacts per angle of displacement.

Additionally, in order to more accurately determine the cumulative angular displacement of the anvil 9 on each hammer impact, a gyroscope, for example, a solid state gyroscope, may be attached to the housing of the impact wrench for determining any angular movement of the housing in free space, and the angular movement of the housing determined by the gyroscope would be added to or subtracted from the computed cumulative angular displacement of the anvil 9 or the hammer 5 on each hammer impact, as appropriate, depending on the direction of the angular movement of the housing.

In the embodiment of the invention described with reference to FIGS. 1 to 8, the fastener is determined as having been tightened to the predetermined tightness level when the number of hammer impacts required to advance the anvil through a predetermined angle is greater than a predetermined number of hammer impacts, and the predetermined angle has been described as being 1.5°. It will of course be appreciated that the value of the predetermined angle may be any desired angular value, and it need not be related to the count of the rotary encoder on each 360° of rotation of the shaft. In fact, the predetermined angle could be 1°, or indeed, any number of degrees of rotation of the anvil, or any number of counts from the rotary encoder.

Additionally, it will be appreciated that the determination as to when the fastener has been tightened to a predetermined tightness level may also be based on the total cumulative angle of displacement of the anvil and/or the number of hammer impacts from the first detected hammer impact, and when so based, may also be based on any one or more of the above three bases, namely, the number of hammer impacts per predetermined angular displacement of the anvil, the angle of rebound of the hammer or the angle of rebound of the hammer weighted by the rate of change of the angle of rebound, and this may be used in conjunction with one or more of the other methods.

The invention claimed is:

1. A method for determining when a threaded fastener has been tightened to a predetermined level of tightness by an impact wrench of the type comprising a microprocessor, a rotary anvil and a rotary hammer for impacting with the anvil and angularly advancing the anvil in response to each hammer impact, and a coupling means for coupling the anvil to the fastener for rotating the fastener as the anvil is being angularly advanced, the method comprising the steps of:

receiving impacts and transmitting impact data to the microprocessor;

determining one of the angle of rebound of the hammer resulting from each of at least some of the impacts of the hammer with the anvil, and the angle by which the anvil is advanced in response to each of at least some of the hammer impacts, the angular position of the anvil on each of the at least some of the hammer impacts with the anvil being determined from the angular position of the hammer at impact with the anvil, and determining that the fastener has been tightened to the predetermined tightness level when one of the angle through which the anvil is advanced by one of the hammer impacts falls below a predetermined angle, the number of hammer impacts to advance the anvil through a predetermined angle exceeds a predetermined number of hammer impacts, and the angle of rebound of the hammer exceeds a predetermined rebound angle.

2. A method as claimed in claim 1 in which the angular position of the hammer at each hammer impact is determined by determining when the forward angular speed of the hammer reduces to zero angular speed.

3. A method as claimed in claim 1 in which the angle through which the anvil is advanced in response to each hammer impact is derived from the angular rotation of the hammer between the corresponding hammer impact and the previous hammer impact.

4. A method as claimed in claim 1 in which the angle through which the anvil is advanced in response to each of the at least some of the hammer impacts is determined using a smoothing algorithm for minimizing the effect of noise on the determined angle.

5. A method as claimed in claim 4 in which the smoothing algorithm is a moving average algorithm.

6. A method for determining when a threaded fastener has been tightened to a predetermined level of tightness by an impact wrench of the type comprising a microprocessor, a rotary anvil and a rotary hammer for impacting with the anvil and angularly advancing the anvil in response to each hammer impact, and a coupling means for coupling the anvil to the fastener for rotating the fastener as the anvil is being angularly advanced, the method comprising:

receiving impacts and transmitting impact data to the microprocessor determining the angle of rebound of the hammer resulting from impact of the hammer with the anvil on each of at least some of the hammer impacts, and determining that the fastener has been tightened to the predetermined tightness level when the angle of rebound of the hammer on an impact with the anvil exceeds a predetermined rebound angle.

7. A method as claimed in claim 6 in which the angular position of the hammer after the hammer has rebounded as a result of each hammer impact is determined by determining when the rearward angular speed of the hammer reduces to zero angular speed after the direction of rotation of the hammer has reversed after the corresponding impact with the anvil.

8. A method as claimed in claim 6 in which the angle of rebound of the hammer resulting from each hammer impact is determined by determining the difference between the cumulative angular displacement of the hammer at the corresponding hammer impact and the cumulative angular displacement of the hammer after the hammer has rebounded.

9. A method as claimed in claim 6 in which the angle of rebound of the hammer as a result of each hammer impact is determined by applying a smoothing algorithm for minimizing the effect of noise on the determined angle.

10. A method as claimed in claim 9 in which the smoothing algorithm is a moving average algorithm.

11. Apparatus for determining when a threaded fastener has been tightened to a predetermined level of tightness by an impact wrench of the type comprising a rotary anvil and a rotary hammer for impacting with the anvil and angularly advancing the anvil in response to each hammer impact, and a coupling means for coupling the anvil to the fastener for rotating the fastener as the anvil is being angularly advanced, the apparatus comprising:

a means for determining one of the angle of rebound of the hammer resulting from each of at least some of the impacts of the hammer with the anvil, and the angle through which the anvil is advanced in response to each of at least some of the hammer impacts, the means for determining the angle through which the anvil is advanced in response to each of at least some of the hammer impacts being adapted for determining the angular position of the anvil from the angular position of the hammer at impact with the anvil, and a means for determining that the fastener has been tightened to the predetermined tightness level when one of the angle through which the anvil is advanced by one of the hammer impacts falls below a predetermined angle, the number of impacts to advance the anvil through a predetermined angle exceeds a predetermined number of hammer impacts, and the angle of rebound of the hammer exceeds a predetermined rebound angle.

12. Apparatus as claimed in claim 11 in which a means for determining the angular position of the hammer on each impact of the hammer with the anvil is provided, and a means for determining the angular position of the anvil on each hammer impact with the anvil is provided, and the means for determining the angular position of the anvil determines the angular position of the anvil from the means for determining the angular position of the hammer, as being equivalent to the angular position of the hammer at the corresponding impact of the hammer with the anvil.

13. Apparatus as claimed in claim 12 in which the means for determining the angular position of the hammer at each hammer impact determines the angular position of the hammer at each hammer impact as being the position of the hammer when the forward angular speed of the hammer reduces to zero angular speed.

14. Apparatus as claimed in claim 12 in which the smoothing algorithm is a moving average algorithm.

15. Apparatus as claimed in claim 11 in which the means for determining the angle through which the anvil is advanced in response to each of the at least some of the hammer impacts determines the angle by applying a smoothing algorithm for minimising the effect of noise on the determined angle.

16. An impact wrench comprising the apparatus as claimed in claim 11 for determining when a threaded fastener has been tightened to a predetermined level of tightness.

17. Apparatus for determining when a threaded fastener has been tightened to a predetermined level of tightness by an impact wrench of the type comprising a rotary anvil and a rotary hammer for impacting with the anvil and angularly advancing the anvil in response to each hammer impact, and a coupling means for coupling the anvil to the fastener for rotating the fastener as the anvil is being angularly advanced, the apparatus comprising:

a means for determining the angle of rebound of the hammer resulting from each of at least some of the impacts of the hammer with the anvil, and a means for determining that the fastener has been tightened to the predetermined tightness level when the angle of rebound of the hammer on an impact with the anvil exceeds a predetermined rebound angle.

18. Apparatus as claimed in claim 17 in which a means is provided for determining the angular position of the hammer on each impact of the hammer with the anvil, and the means for determining the position of the hammer at each hammer impact determines the angular position of the hammer at each hammer impact as being the position of the hammer when the forward angular speed of the hammer is approaching zero angular speed.

19. Apparatus as claimed in claim 17 in which a means for determining the angle of rebound of the hammer resulting from each impact of the hammer with the anvil is provided, and the means for determining the angle of rebound of the hammer determines the angular position of the hammer after the hammer has rebounded as a result of each hammer impact with the anvil by determining the angular position of the hammer when the rearward angular speed of the hammer reduces to zero angular speed after the direction of rotation of the hammer has reversed after the corresponding impact with the anvil.

20. Apparatus as claimed in claim 17 in which the means for determining the angle of rebound of the hammer as a result of each hammer impact applies a smoothing algorithm for minimizing the effect of noise on the determined angle.

21. Apparatus as claimed in claim 20 in which the smoothing algorithm is a moving average algorithm.

* * * * *

UNITED STATES PATENT AND TRADEMARK OFFICE

CERTIFICATE OF CORRECTION

PATENT NO. : 8,196,673 B2
APPLICATION NO. : 12/375809
DATED : June 12, 2012
INVENTOR(S) : Paul William Wallace It is certified that error appears in the above-identified patent and that said Letters Patent is hereby corrected as shown below:

Column 28, after line 36, insert claim 22 as follows:

-- 22. Apparatus as claimed in Claim 11 in which the means for determining the angle through which the anvil is advanced in response to each hammer impact determines the angle from the angular rotation of the hammer between the corresponding hammer impact and the previous hammer impact. --

Signed and Sealed this
Fifteenth Day of January, 2013

David J. Kappos

David J. Kappos
*Director of the United States Patent and Trademark Office*

UNITED STATES PATENT AND TRADEMARK OFFICE

CERTIFICATE OF CORRECTION

PATENT NO. : 8,196,673 B2
APPLICATION NO. : 12/375809
DATED : June 12, 2012
INVENTOR(S) : Paul William Wallace It is certified that error appears in the above-identified patent and that said Letters Patent is hereby corrected as shown below:

Delete the title page and substitute therefore the attached title page showing the corrected number of claims in patent.

Column 28, after line 36, insert claim 22 as follows:

-- 22. Apparatus as claimed in Claim 11 in which the means for determining the angle through which the anvil is advanced in response to each hammer impact determines the angle from the angular rotation of the hammer between the corresponding hammer impact and the previous hammer impact. --

This certificate supersedes the Certificate of Correction issued January 15, 2013.

Signed and Sealed this
Nineteenth Day of February, 2013

Teresa Stanek Rea
*Acting Director of the United States Patent and Trademark Office*

(12) United States Patent
Wallace

(10) Patent No.: US 8,196,673 B2
(45) Date of Patent: Jun. 12, 2012

(54) METHOD AND APPARATUS FOR DETERMINING WHEN A THREADED FASTENER HAS BEEN TIGHTENED TO A PREDETERMINED TIGHTNESS

(76) Inventor: Paul William Wallace, Furlong, PA (US)

( * ) Notice: Subject to any disclaimer, the term of this patent is extended or adjusted under 35 U.S.C. 154(b) by 55 days.

(21) Appl. No.: 12/375,809

(22) PCT Filed: Aug. 2, 2007

(86) PCT No.: PCT/IE2007/000077

§ 371 (c)(1), (2), (4) Date: Apr. 22, 2009

(87) PCT Pub. No.: WO2008/015661

PCT Pub. Date: Feb. 7, 2008

(65) Prior Publication Data

US 2009/0250233 A1 Oct. 8, 2009

(30) Foreign Application Priority Data

Aug. 2, 2006 (IE) ..... S2006/0573

(51) Int. Cl.
*B25B 21/00* (2006.01)

(52) U.S. Cl. ..... 173/1; 173/176

(58) Field of Classification Search ..... 173/1, 176, 173/183; 73/862.21; 81/467
See application file for complete search history.

(56) References Cited

U.S. PATENT DOCUMENTS

| | | | | |
|---|---|---|---|---|
| 4,305,471 | A * | 12/1981 | Eshghy | 173/183 |
| 4,358,735 | A | 11/1982 | Boys | |
| 4,400,785 | A * | 8/1983 | Wallace et al. | 702/43 |
| RE31,569 | E * | 5/1984 | Eshghy | 29/407.02 |
| 4,609,089 | A | 9/1986 | Kobayashi et al. | |
| 2002/0134172 | A1 * | 9/2002 | Yamada et al. | 73/862.21 |

FOREIGN PATENT DOCUMENTS

| | | | |
|---|---|---|---|
| EP | 1059145 | A2 | 12/2000 |
| EP | 1447177 | A2 | 8/2004 |
| EP | 1524085 | A2 | 4/2005 |
| EP | 1595650 | A2 | 11/2005 |
| WO | 02060650 | A2 | 8/2002 |

* cited by examiner

*Primary Examiner* — Rinaldi Rada
*Assistant Examiner* — Nathaniel Chukwurah
(74) *Attorney, Agent, or Firm* — Sughrue Mion, PLLC

(57) ABSTRACT

Apparatus for determining when a fastener has been tightened by an impact wrench comprises determining when the number of hammer impacts to advance an anvil of the impact wrench through a predetermined angle reaches a predetermined number. The cumulative angular displacement of the anvil from the first detected hammer impact is determined from the corresponding cumulative angular displacement of the hammer at the corresponding hammer impact from the first detected hammer impact. The cumulative angular displacement of the hammer is determined just prior to the direction of rotation of the hammer reversing at the corresponding hammer impact, and is determined by computing the difference between the cumulative angular displacements of the hammer at the corresponding and previous hammer impacts and subtracting an angle through which the hammer freely rotates between the two hammer impacts from the computed difference. The result is added to the cumulative angular displacement of the anvil computed for the previous hammer impact.

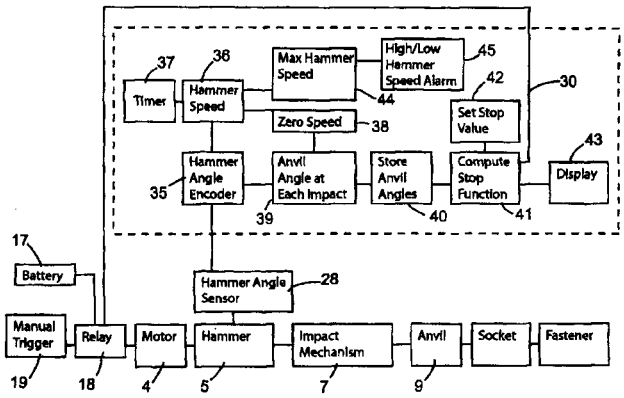

22 Claims, 10 Drawing Sheets